US010893591B2

(12) United States Patent
Lee et al.

(10) Patent No.: US 10,893,591 B2
(45) Date of Patent: Jan. 12, 2021

(54) CONTROLLERS, SYSTEMS, AND METHODS FOR DRIVING A LIGHT SOURCE

(71) Applicant: O2Micro, Inc., Santa Clara, CA (US)

(72) Inventors: Sheng-tai Lee, Taipei (TW); Kaiping Ran, Fremont, CA (US)

(73) Assignee: O2Micro, Inc., Santa Clara, CA (US)

( * ) Notice: Subject to any disclaimer, the term of this patent is extended or adjusted under 35 U.S.C. 154(b) by 0 days.

(21) Appl. No.: 16/846,092

(22) Filed: Apr. 10, 2020

(65) Prior Publication Data

US 2020/0245432 A1 Jul. 30, 2020

Related U.S. Application Data

(63) Continuation-in-part of application No. 15/414,003, filed on Jan. 24, 2017, now Pat. No. 10,660,176.

(60) Provisional application No. 62/286,752, filed on Jan. 25, 2016.

(51) Int. Cl.

| | |
|---|---|
| ***H05B 45/34*** | (2020.01) |
| ***H05B 45/345*** | (2020.01) |
| ***H05B 45/10*** | (2020.01) |
| ***H05B 45/24*** | (2020.01) |
| ***H05B 45/395*** | (2020.01) |
| ***H05B 45/00*** | (2020.01) |
| ***H05B 45/14*** | (2020.01) |

(52) U.S. Cl.

CPC ..... *H05B 45/34* (2020.01); *H05B 45/00* (2020.01); *H05B 45/10* (2020.01); *H05B 45/14* (2020.01); *H05B 45/24* (2020.01); *H05B 45/345* (2020.01); *H05B 45/395* (2020.01)

(58) Field of Classification Search

CPC ..... H05B 45/34; H05B 45/24; H05B 45/395; H05B 45/00; H05B 45/14; H05B 45/345; H05B 45/10

See application file for complete search history.

(56) References Cited

U.S. PATENT DOCUMENTS

| | | | | |
|---|---|---|---|---|
| 7,852,649 | B2 * | 12/2010 | Hsiao | H05B 45/50 363/97 |
| 8,288,969 | B2 * | 10/2012 | Hsu | H05B 45/46 315/360 |
| 8,405,320 | B2 * | 3/2013 | Huang | H05B 45/50 315/291 |
| 8,711,119 | B2 * | 4/2014 | Liu | G06F 3/0416 345/173 |
| 8,907,592 | B2 * | 12/2014 | Hu | H05B 45/395 315/308 |

(Continued)

*Primary Examiner* — Borna Alaeddini

(57) ABSTRACT

A controller includes a voltage detection terminal, a current detection terminal and a voltage sensing terminal. The voltage detection terminal senses a second output voltage. The current detection terminal senses a current of a light source. The second output voltage is sensed prior to the current of the light source. The voltage sensing terminal receives a voltage sensing signal indicative of a first output voltage. The controller adjusts the voltage sensing signal based on the second output voltage, to enable the second output voltage in a preset voltage range; when the second output voltage is in the preset voltage range, the controller adjusts the adjusted voltage sensing signal based on a difference between the current of the light source and a target current value, to enable the current of the light source to maintain the target current value.

37 Claims, 6 Drawing Sheets

(56) References Cited

U.S. PATENT DOCUMENTS

| | | | | |
|---|---|---|---|---|
| 9,468,055 | B2 * | 10/2016 | Cheng | H05B 47/10 |
| 9,829,905 | B2 * | 11/2017 | Mitchell | G05F 3/26 |
| 10,660,176 | B2 * | 5/2020 | Chen | H05B 45/10 |
| 2002/0030455 | A1 * | 3/2002 | Ghanem | H05B 45/14 315/291 |
| 2010/0244711 | A1 * | 9/2010 | Gray | H05B 45/37 315/185 R |
| 2011/0221795 | A1 * | 9/2011 | Ran | H05B 45/46 345/690 |
| 2011/0255311 | A1 * | 10/2011 | Hsu | H02M 3/33507 363/21.15 |
| 2012/0049761 | A1 * | 3/2012 | Yu | H05B 45/46 315/294 |
| 2012/0091816 | A1 * | 4/2012 | Liu | H02J 7/02 307/80 |
| 2012/0176066 | A1 * | 7/2012 | Lin | H05B 45/44 315/307 |
| 2013/0026926 | A1 * | 1/2013 | Oh | G09G 3/342 315/122 |
| 2014/0292220 | A1 * | 10/2014 | Trattler | H05B 45/37 315/287 |
| 2015/0022109 | A1 * | 1/2015 | Lee | H05B 45/395 315/200 R |
| 2015/0216009 | A1 * | 7/2015 | Lee | H05B 45/10 315/307 |
| 2016/0143095 | A1 * | 5/2016 | Lee | H05B 45/395 315/122 |
| 2016/0295657 | A1 * | 10/2016 | Suzuki | H05B 45/10 |
| 2020/0178371 | A1 * | 6/2020 | Malyna | H05B 45/58 |

* cited by examiner

CONTROLLERS, SYSTEMS, AND METHODS FOR DRIVING A LIGHT SOURCE

RELATED APPLICATION

This application is a continuation-in-part application of the co-pending U.S. application Ser. No. 15/414,003, titled "System and Method for Driving Light Source," filed on Jan. 24, 2017, which claims priority to the U.S. provisional application, Ser. No. 62/286,752, titled "Light-Source Driving Systems, filed Jan. 25, 2016, which are both hereby incorporated by reference in their entireties.

BACKGROUND

At present, light-emitting-diode (LED) light sources having controllable brightness are widely used in many applications. The brightness of LED light sources needs to be adjusted for different applications. In general, a system for driving the light sources adjusts an output voltage that powers the light sources, to enable currents flowing through the light sources to be adjusted to a target current value and thereby adjust their brightness. However, this method consumes power, which increases power consumption and reduces power efficiency.

SUMMARY

Embodiments in accordance with the present invention provide controllers, systems, and methods for driving a light source.

In embodiments, a controller is operable for controlling a first output voltage that supplies electric power to a light source and for controlling a second output voltage that supplies electric power to components except for the light source, where the first output voltage and the second output voltage are generated by a power converter, the controller includes: a voltage detection terminal, operable for sensing the second output voltage; a current detection terminal coupled to the light source is operable for sensing a current of the light source, where the second output voltage is sensed prior to the current of the light source; a voltage sensing terminal, coupled to the power converter through a voltage sensing circuit, operable for receiving a voltage sensing signal indicative of the first output voltage, where the voltage sensing signal is generated by the voltage sensing circuit; where the controller adjusts the voltage sensing signal according to the second output voltage, to generate an adjusted voltage sensing signal, and generates a first control current according to the adjusted voltage sensing signal, to enable the power converter to control the second output voltage in a preset voltage range according to the first control current; when the second output voltage is in the preset voltage range; the controller adjusts the adjusted voltage sensing signal according to a difference between the current of the light source and a target current value, to generate a twice-adjusted voltage sensing signal, and generates a second control current according to the twice-adjusted voltage sensing signal, to enable the power converter to control the current of the light source to maintain the target current value according to the second control current.

In embodiments, a system for driving a light source includes: a power converter, operable for converting an input power to a first output voltage that supplies electric power to the light source, and also operable for converting the input power to a second output voltage that supplies electric power to components in the system except for the light source; and a control circuit, coupled to the power converter and the light source, operable for sensing the first output voltage, the second output voltage and a current of the light source; where both the first output voltage and the second output voltage are sensed prior to the current of the light source, where the control circuit generates a voltage sensing signal according to the first output voltage, adjusts the voltage sensing signal according to the second output voltage, to generate an adjusted voltage sensing signal, and generates a first control signal according to the adjusted voltage sensing signal, to enable the power converter to control the second output voltage in a preset voltage range according to the first control signal; where when the second output voltage is in the preset voltage range, the control circuit adjusts the adjusted voltage sensing signal according to the current of the light source, to generate a twice-adjusted voltage sensing signal, and generates a second control signal according to the twice-adjusted voltage sensing signal, to enable the power converter to control the current of the light source to maintain a target current value according to the second control signal.

In embodiments, a method for driving a light source includes: converting, using a power converter, an input power to a first output voltage that supplies electric power to the light source and a second output voltage that supplies electric power to components except for the light source; sensing, using a control circuit, the first output voltage, the second output voltage and a current of the light source; where both the first output voltage and the second output voltage are sensed prior to the current of the light source; generating, using the control circuit, a voltage sensing signal indicative of the first output voltage; adjusting, using the control circuit, the voltage sensing signal according to the second output voltage, to generate an adjusted voltage sensing signal; generating, using the control circuit, a first control signal according to the adjusted voltage sensing signal; adjusting, using the power converter, the second output voltage according to the first control signal, to enable the second output voltage in a preset voltage range; adjusting, using the control circuit, the adjusted voltage sensing signal according to the current of the light source, to generate a twice-adjusted voltage sensing signal, when the second output voltage is in the preset voltage range; generating, using the control circuit, a second control signal according to the twice-adjusted voltage sensing signal, when the second output voltage is in the preset voltage range; and adjusting, using the power converter, the first output voltage according to the second control signal, to enable the current of the light source to maintain a target current value.

BRIEF DESCRIPTION OF THE DRAWINGS

Features and advantages of embodiments of the present invention will become apparent as the following detailed description proceeds, and upon reference to the drawings, wherein like numerals depict like parts, and in which.

DETAILED DESCRIPTION

Reference will now be made in detail to the embodiments of the present invention. While the invention will be described in combination with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Some portions of the detailed descriptions that follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those utilizing physical manipulations of physical quantities. Usually, although not necessarily, these quantities take the form of electrical or magnetic signals capable of being stored, transferred, combined, compared, and otherwise manipulated in a computing system. It has proven convenient at times, principally for reasons of common usage, to refer to these signals as transactions, bits, values, elements, symbols, characters, samples, pixels, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "generating," "converting," "sensing," "outputting," "adjusting," "controlling," or the like, refer to actions and processes of a computing system or similar electronic computing device or processor. A computing system or similar electronic computing device manipulates and transforms data represented as physical (electronic) quantities within the computing system memories, registers or other such information storage, transmission or display devices.

Figure 1:
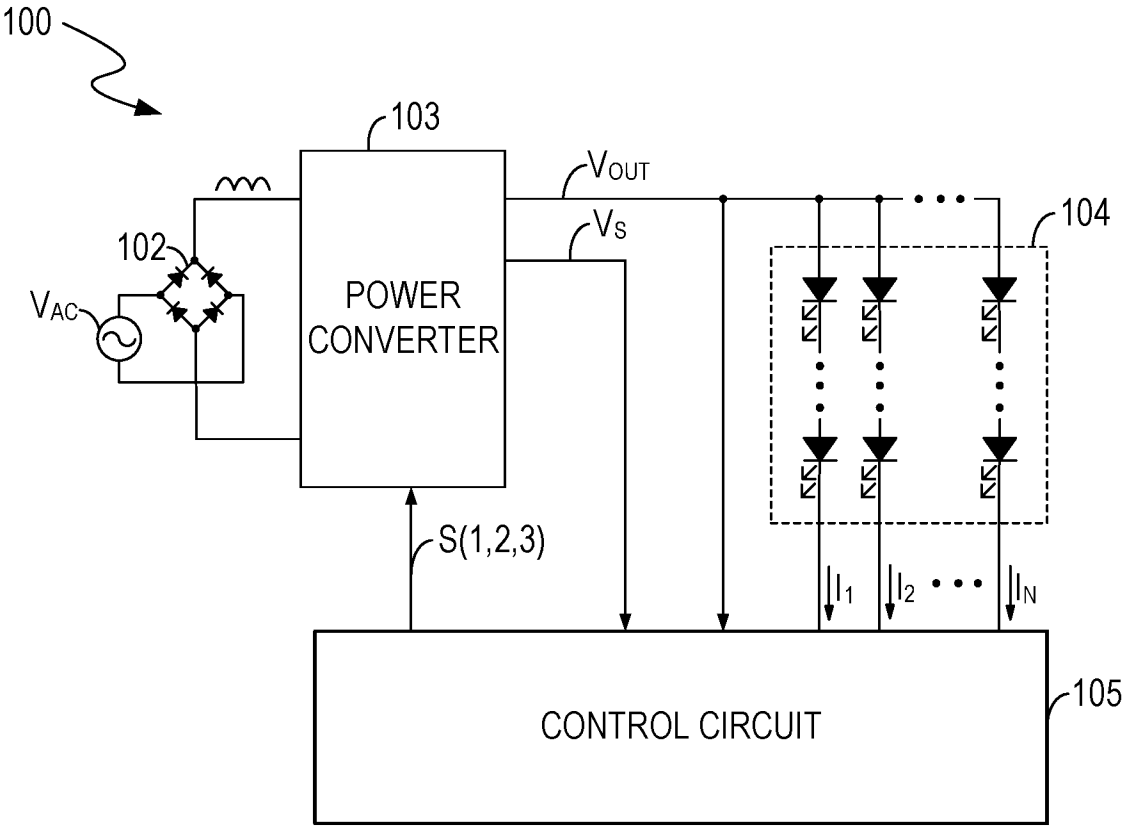
FIG. 1 shows a block diagram illustrating a system for driving a light source, in accordance with embodiments of the present invention.

FIG. 1 shows a block diagram illustrating a system 100 for driving a light source 104, in accordance with embodiments of the present invention. The system 100 includes a power source $V_{AC}$, a rectifier 102, a power converter 103, the light source 104, and a control circuit 105.

In an embodiment, the light source 104 includes multiple light emitting diode (LED) strings (e.g., LED strings S1, S2, . . . , SN in FIG. 2) coupled in parallel. Each LED string includes multiple LEDs coupled in series. The first output voltage $V_{OUT}$ supplies electric power to each LED string, and LED currents $I_1, I_2, \ldots, I_N$ through the LED strings S1, S2, . . . , SN, respectively, are generated. The current of the light source 104 includes the LED currents $I_1, I_2, \ldots, I_N$. In other embodiments, the light source 104 can include one LED or one LED string.

The rectifier 102 is coupled between the power source $V_{AC}$ and the power converter 103, rectifies electric power (e.g., 220V, 110V, or the like) supplied by the power source $V_{AC}$, and supplies rectified power (e.g., input power) to the power converter 103. In the embodiment, the rectifier 102 includes a full-bridge rectifier.

The power converter 103 is coupled to the light source 104 and a control circuit 105, respectively, and converts the input power to a first output voltage $V_{OUT}$ to power the light source 104, and also converts the input power to a second output voltage $V_S$ to power the components in the system 100 except for the light source 104. In an embodiment, the power converter 103 is an AC/DC (alternating current/direct current) converter.

The control circuit 105 is coupled to the light source 104 and the power converter 103, and senses the first output voltage $V_{OUT}$, the second output voltage $V_S$, and the LED currents $I_1, I_2, \ldots, I_N$. Both the first output voltage $V_{OUT}$ and the second output voltage $V_S$ are sensed prior to the LED currents $I_1, I_2, \ldots, I_N$. The control circuit 105 generates a voltage sensing signal $V_{SEN}$ (an unadjusted voltage sensing signal $V_{SEN}$) according to the first output voltage $V_{OUT}$, adjusts the voltage sensing signal $V_{SEN}$ according to the second output voltage $V_S$, to generate an adjusted voltage sensing signal $V_{SEN}$, and generates a first control signal S1 according to the adjusted voltage sensing signal $V_{SEN}$ (not shown in FIG. 1), to enable the power converter 103 to control the second output voltage $V_S$ in the preset voltage range according to the first control signal S1. When the second output voltage $V_S$ is in a preset voltage range, the control circuit 105 adjusts the adjusted voltage sensing signal $V_{SEN}$ according to the LED currents $I_1, I_2, \ldots, I_N$, to generate a twice-adjusted voltage sensing signal $V_{SEN}$, and generates a second control signal S2 according to the twice-adjusted voltage sensing signal $V_{SEN}$, to enable the power converter 103 to control the LED currents $I_1, I_2, \ldots, I_N$ to maintain a target current value according to the second control signal S2. As used herein, the term "twice-adjusted" means that the signal is adjusted, and the adjusted signal is subsequently adjusted again; the term does not necessarily mean that the signal is adjusted only twice. The target current value and the preset voltage range can be specified by design and/or set by a user. In an embodiment, the preset voltage range is 7V (volts) to 25V.

As mentioned above, the system 100 can adjust the first output voltage $V_{OUT}$ through the power converter 103, to enable the current of the light source 104 to maintain the target current value, thereby reducing power consumption. The system 100 also can adjust the second output voltage $V_S$ through the power converter 103, to enable the second output voltage $V_S$ in the preset voltage range. The system 100 is thereby compatible with a variety of displays.

Figure 2:
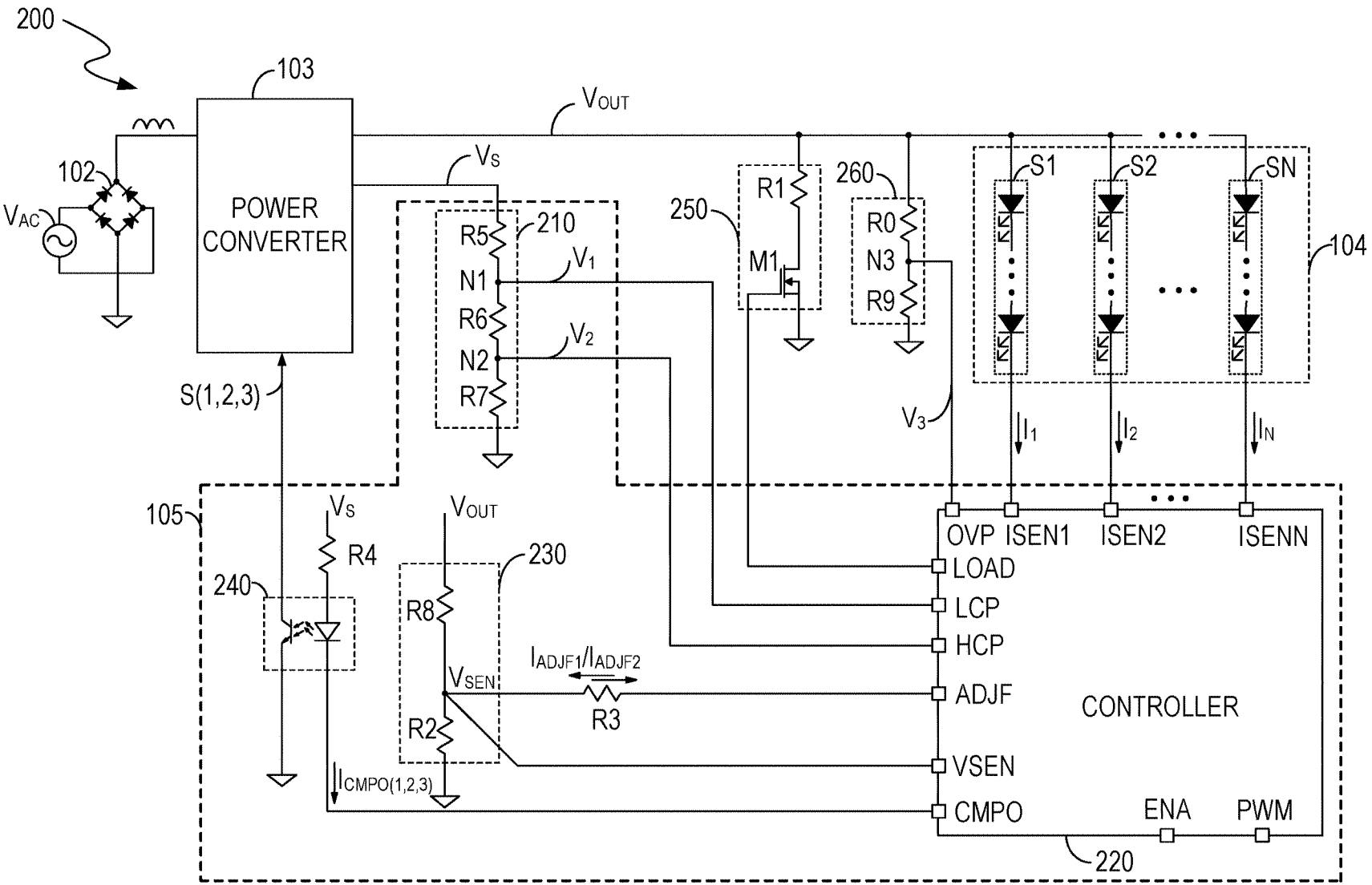
FIG. 2 shows a circuit diagram illustrating a system for driving a light source, in accordance with embodiments of the present invention.

FIG. 2 shows a block diagram illustrating a system 200 for driving the light source 104, in accordance with embodiments of the present invention. In an embodiment, FIG. 2 is an example of the system 100 of FIG. 1. For clarity of illustration, some components in the system 200 are not shown in FIG. 2. In the FIG. 2 embodiment, the system 200 includes the power source $V_{AC}$, the rectifier 102, the power converter 103, the light source 104, the control circuit 105, a load unit 250, and an overvoltage protection unit 260. The control circuit 105 includes a voltage monitoring circuit 210, a controller 220, a voltage sensing circuit 230, and an optical coupler 240.

The voltage monitoring circuit 210 is coupled to the power converter 103, senses the second output voltage $V_S$, generates a first monitoring voltage $V_1$ indicative of the second output voltage $V_S$, and also generates a second monitoring voltage $V_2$ indicative of the second output voltage $V_S$. In an embodiment, the voltage monitoring circuit 210 includes resistors R5, R6, and R7. A terminal of the resistor R5 is connected to the power converter 103 to receive the second output voltage $V_S$, and the other terminal of the resistor R5 is connected to a terminal of the resistor R6 to form a node N1. The first monitoring voltage $V_1$ is generated at the node N1. The other terminal of the resistor R6 is connected to a terminal of the resistor R7 at a node N2. The second monitoring voltage $V_2$ is generated at the node N2. In the embodiment, $V_1=V_S(R_6+R_7)/(R_5+R_6+R_7)$, and $V_2=V_SR_7/(R_5+R_6+R_7)$, where $R_5$ represents the resistance value of the resistor R5, $R_6$ represents the resistance value of the resistor R6, and $R_7$ represents the resistance value of the resistor R7.

The controller 220 is coupled to the light source 104 and the voltage monitoring circuit 210, and receives the first monitoring voltage $V_1$, the second monitoring voltage $V_2$, and the LED currents $I_1, I_2, \ldots, I_N$. The first monitoring voltage $V_1$ and the second monitoring voltage $V_2$ are received prior to the LED currents $I_1, I_2, \ldots, I_N$. The controller 220 generates a first adjusting current $I_{ADJF1}$ indicative of the first monitoring voltage $V_1$ and the second monitoring voltage $V_2$, to enable the second output voltage $V_S$ in the preset voltage range. When the second output voltage $V_S$ is in the preset voltage range, the controller 220 generates a second adjusting current $I_{ADJF2}$ indicative of the differences between each of the LED currents $I_1, I_2, \ldots, I_N$ and the target current value, to enable the LED currents $I_1, I_2, \ldots, I_N$ to maintain the target current value.

The voltage sensing circuit 230 is coupled to the controller 220 and the power converter 103, and generates the voltage sensing signal $V_{SEN}$ (the unadjusted voltage sensing signal $V_{SEN}$) indicative of the first output voltage $V_{OUT}$ according to the first output voltage $V_{OUT}$. The first adjusting current $I_{ADJF1}$ adjusts the voltage sensing signal $V_{SEN}$ (the unadjusted voltage sensing signal $V_{SEN}$), to generate the adjusted voltage sensing signal $V_{SEN}$. The second adjusting current $I_{ADJF2}$ adjusts the adjusted voltage sensing signal $V_{SEN}$, to generate the twice-adjusted voltage sensing signal $V_{SEN}$.

As described above, the first adjusting current $I_{ADJF1}$ indicates the second output voltage $V_S$, and the voltage sensing signal $V_{SEN}$ (the unadjusted voltage sensing signal $V_{SEN}$) indicates the first output voltage $V_{OUT}$. The adjusted voltage sensing signal $V_{SEN}$ thus indicates a combination of the first output voltage $V_{OUT}$ and the second output voltage $V_S$ after the voltage sensing signal $V_{SEN}$ (the unadjusted voltage sensing signal $V_{SEN}$) is adjusted by the first adjusting current $I_{ADJF1}$ ($I_{ADJF1}\neq 0$), and the adjusted voltage sensing signal $V_{SEN}$ also indicates the first output voltage $V_{OUT}$ after the voltage sensing signal $V_{SEN}$ (the unadjusted voltage sensing signal $V_{SEN}$) is adjusted by the first adjusting current $I_{ADJF1}$ ($I_{ADJF1}=0$).

The second adjusting current $I_{ADJF2}$ indicates the LED currents $I_1, I_2, \ldots, I_N$, and the adjusted voltage sensing signal $V_{SEN}$ indicates a combination of the first output voltage $V_{OUT}$ and the second output voltage $V_S$. The dual-adjusted voltage sensing signal $V_{SEN}$ thus indicates a combination of the first output voltage $V_{OUT}$, the second output voltage $V_S$, and the LED currents $I_1, I_2, \ldots, I_N$ after the adjusted voltage sensing signal $V_{SEN}$ is adjusted by the second adjusting current $I_{ADJF2}$ ($I_{ADJF1}\neq 0$, $I_{ADJF2}\neq 0$), and the dual-adjusted voltage sensing signal $V_{SEN}$ also indicates a combination of the first output voltage $V_{OUT}$ and the second output voltage $V_S$ after the adjusted voltage sensing signal $V_{SEN}$ is adjusted by the second adjusting current $I_{ADJF2}$ ($I_{ADJF1}\neq 0$, $I_{ADJF2}=0$). The second adjusting current $I_{ADJF2}$ indicates the LED currents $I_1, I_2, \ldots, I_N$, and the adjusted voltage sensing signal $V_{SEN}$ indicates the first output voltage $V_{OUT}$. The twice-adjusted voltage sensing signal $V_{SEN}$ thus indicates a combination of the first output voltage $V_{OUT}$ and the LED currents $I_1, I_2, \ldots, I_N$ after the adjusted voltage sensing signal $V_{SEN}$ is adjusted by the second adjusting current $I_{ADJF2}$ ($I_{ADJF1}=0$, $I_{ADJF2}\neq 0$), and the twice-adjusted voltage sensing signal $V_{SEN}$ also indicates the first output voltage $V_{OUT}$ after the adjusted voltage sensing signal $V_{SEN}$ is adjusted by the second adjusting current $I_{ADJF2}$ ($I_{ADJF1}=0$, $I_{ADJF2}=0$).

In an embodiment, the voltage sensing circuit 230 can be a voltage divider composed of a resistor R2 and a resistor R8. A terminal of the resistor R8 is connected to the power converter 103 to receive the first output voltage $V_{OUT}$, and the other terminal of the resistor R8 is connected to the resistor R2 at a connection node. The voltage sensing signal $V_{SEN}$ generated at the connection node is the voltage value across the resistor R2. The first adjusting current $I_{ADJF1}$ and the second adjusting current $I_{ADJF2}$ can flow into the connection node or flow from the connection node, which changes the voltage value across the resistor R2. For example, if both the first adjusting current $I_{ADJF1}$ and the second adjusting current $I_{ADJF2}$ are not generated ($I_{ADJF1}=0$ and $I_{ADJF2}=0$), the voltage value across the resistor R2 is linearly proportional to the first output voltage $V_{OUT}$, e.g., $V_{SEN}=V_{OUT}\cdot R_2/(R_2+R_8)$, where $R_2$ represents the resistance value of the resistor R2, and $R_8$ represents the resistance value of the resistor R8. If the first adjusting current $I_{ADJF1}$ or the second adjusting current $I_{ADJF2}$ flows into the connection node, the voltage value across the resistor R2 is increased. If the first adjusting current $I_{ADJF1}$ or the second adjusting current $I_{ADJF2}$ flows from the connection node, the voltage value across the resistor R2 is reduced.

The controller 220 generates a control current $I_{CMPO}$ (which may be the first control current $I_{CMPO1}$, the second control current $I_{CMPO2}$, or the third control current $I_{CMPO3}$, similarly hereinafter in this paragraph) according to a comparison result of the voltage sensing signal $V_{SEN}$ (which may be the unadjusted voltage sensing signal $V_{SEN}$, the adjusted voltage sensing signal $V_{SEN}$, or the twice-adjusted voltage sensing signal $V_{SEN}$, similarly hereinafter in this paragraph) and a voltage reference signal $V_{REF}$ (shown in FIG. 3). The control current $I_{CMPO}$ flows into the controller 220. More specifically, if the voltage sensing signal $V_{SEN}$ is greater than the voltage reference signal $V_{REF}$, the control current $I_{CMPO}$ generated by the controller 220 is reduced. If the voltage sensing signal $V_{SEN}$ is less than the voltage reference signal $V_{REF}$, the control current $I_{CMPO}$ generated by the controller 220 is increased.

The optical coupler 240 is coupled to the power converter 103, and generates the control signal S (which may be the first control signal S1, the second control signal S2, or the third control signal S3, similarly hereinafter in this paragraph) according to the control current $I_{CMPO}$ (which may be the first control current $I_{CMPO1}$, the second control current $I_{CMPO2}$, or the third control current $I_{CMPO3}$, similarly hereinafter in this paragraph). More specifically, the optical coupler 240 generates the first control signal S1 according to the first control current $I_{CMPO1}$, generates the second control signal S2 according to the second control current $I_{CMPO2}$, and also generates the third control signal S3 according to the third control current $I_{CMPO3}$. The power converter 103 adjusts the second output voltage $V_S$ according to the first control signal S1, to enable the second output voltage $V_S$ in the preset voltage range, or adjusts the first output voltage $V_{OUT}$ according to the second control signal S2, to enable the LED currents $I_1, I_2, \ldots, I_N$ to maintain the target current value. The power converter 103 adjusts the first output voltage $V_{OUT}$ according to the third control signal S3, to enable the first output voltage $V_{OUT}$ equal to a target voltage value $V_{TARGET}$ determined by a voltage reference signal $V_{REF}$ (the details are described further below).

In an embodiment, the optical coupler 240 is a component that transfers electrical signals between two isolated circuits using light. An equivalent circuit of the optical coupler 240 includes an LED and a phototransistor. A positive electrode of the LED is connected to the second output voltage $V_S$ through a resistor R4, and a negative electrode of the LED is connected to the control terminal CMPO. An emitter of the phototransistor is connected to a ground, a collector of the phototransistor is connected to the power converter 103, and a base of the phototransistor receives light energy emitted by the LED. The control current $I_{CMPO}$ through the LED can enable the LED to emit light energy. The phototransistor receives the light energy emitted by the LED and generates an electrical signal. The electrical signal can be a collector-emitter voltage $V_{CE}$ or a collector current $I_C$. The phototransistor controls its resistance value according to the collector-emitter voltage $V_{CE}$ or the collector current $I_C$. For example, if the control current $I_{CMPO}$ is increased, the light energy emitted by the LED is also increased. Consequently, the resistance value of the phototransistor is reduced, the collector-emitter voltage $V_{CE}$ is increased, and the control signal S in a second state (e.g., a high level) is generated. If the control current $I_{CMPO}$ is reduced, the light energy emitted by the LED is also reduced. Consequently, the resistance value of the phototransistor is increased, the collector-emitter voltage $V_{CE}$ is reduced, and the control signal S in a first state (e.g., a low level) is generated.

The power converter 103 reduces the first output voltage $V_{OUT}$ and the second output voltage $V_S$ according to the control signal S in a first state (e.g., a low level). Alternatively, the power converter 103 increases the first output voltage $V_{OUT}$ and the second output voltage $V_S$ according to the control signal S in a second state (e.g., a high level).

The load unit 250 is coupled between the power converter 103 and the controller 220. The load unit 250 is turned on for a preset time period under the control of the controller 220, to reduce the first output voltage $V_{OUT}$. In an embodiment, the load unit 250 includes a resistor R1 and a MOS (metal-oxide-semiconductor) transistor M1. A terminal of the resistor R1 is connected to the power converter 103, and the other terminal of the resistor R1 is connected to a drain of the MOS transistor M1. A source of the MOS transistor M1 is connected to a ground, and a gate of the MOS transistor M1 is connected to the controller 220. If the light source 104 is lit, the controller 220 controls the MOS transistor M1 to turn on for the preset time period. During the preset time period, the first output voltage $V_{OUT}$ is reduced after the resistor R1 is applied to the first output voltage $V_{OUT}$. During this time, the reduced first output voltage $V_{OUT}$ will not cause the light source 104 to flicker or be burnt out. The preset time period is specified by design and/or set by a user.

The overvoltage protection unit 260 is connected to the power converter 103, and senses a third monitoring voltage $V_3$ indicative of the first output voltage $V_{OUT}$. The controller 220 performs protection operations according to the third monitoring voltage $V_3$; the details are described below.

In an embodiment, the overvoltage protection unit 260 includes a resistor R0 and a resistor R9. A terminal of the resistor R0 is connected to the power converter 103, and the other terminal of the resistor R0 is connected to the resistor R9 at a node N3. The other terminal of the resistor R9 is connected to a ground. The third monitoring voltage $V_3$ generated at the node N3 is a voltage value across the resistor R9. In the embodiment, $V_3=V_{OUT}\cdot R_9/(R_0+R_9)$, where $R_0$ represents the resistance value of the resistor R0, and $R_9$ represents the resistance value of the resistor R9.

Figure 3:
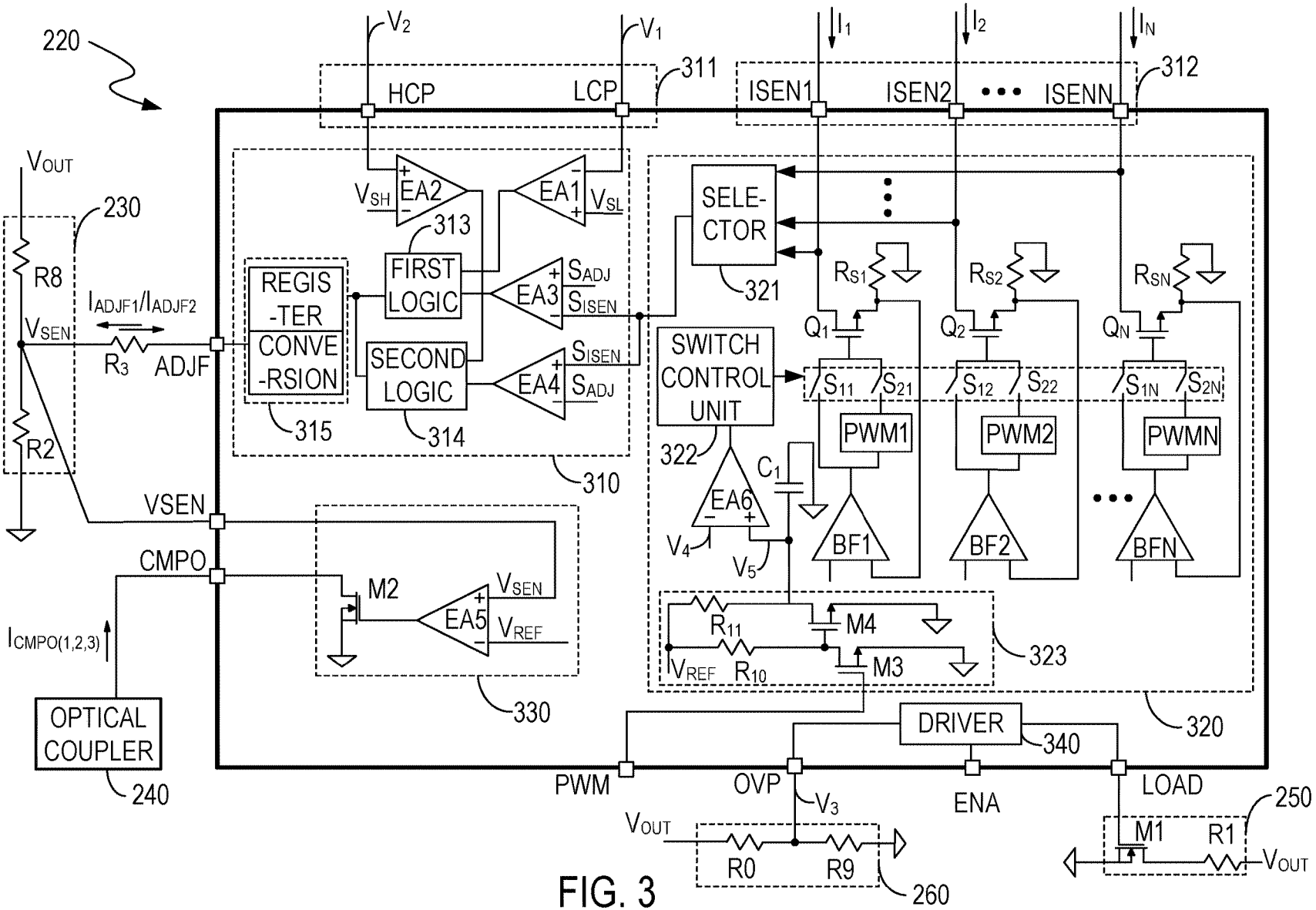
FIG. 3 shows a circuit diagram illustrating a controller, in accordance with embodiments of the present invention.

FIG. 3 shows a circuit diagram illustrating the controller 220, in accordance with embodiments of the present invention. In an embodiment, the controller 220 includes a voltage detection terminal 311, a current detection terminal 312, a adjusting terminal ADJF, a voltage sensing terminal $V_{SEN}$, a control terminal CMPO, an overvoltage protection terminal OVP, a pulse width modulation terminal PWM, an enable terminal ENA, a load terminal LOAD, a comparator and feedback circuit 310, a current sensing and balancing circuit 320, a shunt regulator 330, and a driver 340.

The voltage detection terminal 311 is coupled to the voltage monitoring circuit 210 of the system 200. The voltage detection terminal 311 senses the second output voltage $V_S$ generated by the power converter 103. The second output voltage $V_S$ supplies electric power to the components in the system 200 except for the light source 104.

In an embodiment, the voltage detection terminal 311 includes a high clamp terminal HCP and a low clamp terminal LCP. The low clamp terminal LCP is connected to the node N1 in the voltage monitoring circuit 210, to receive the first monitoring voltage $V_1$ indicative of the second output voltage $V_S$. The high clamp terminal HCP is connected to the node N2 in the voltage monitoring circuit 210, to receive the second monitoring voltage $V_2$ indicative of the second output voltage $V_S$.

The current detection terminal 312 is coupled to the light source 104, and senses the LED currents $I_1, I_2, \ldots, I_N$. In an embodiment, the current detection terminal 312 includes current detection terminals ISEN1, ISEN2, . . . , ISENN. The current detection terminal ISENj (j=1, 2, . . . , N) is coupled to the LED string Sj and senses the LED current $I_j$ flowing through the LED string Sj. The priority of the voltage detection terminal 311 is higher than the current detection terminal 312. In other words, the second output voltage $V_S$ is sensed prior to the LED currents $I_1, I_2, \ldots, I_N$. The controller 220 generates the first adjusting current $I_{ADJF1}$ indicative of the second output voltage $V_S$, to enable the second output voltage $V_S$ in the preset voltage range. When the second output voltage $V_S$ is in the preset voltage range, the current detection terminal 312 senses the LED currents $I_1, I_2, \ldots, I_N$.

The pulse width modulation terminal PWM receives a dimming signal that is indicative of the preset brightness of the light source 104. In an embodiment, the dimming signal includes a rectangular wave signal having a high level and a low level. For example, when the preset brightness is 100% of the total brightness, the dimming signal is at a high level. When the preset brightness is 0% of the total brightness, the dimming signal is at a low level. When the preset brightness is between 0% and 100% of the total brightness, the dimming signal is a rectangular wave signal composed of high and low levels.

The current sensing and balancing circuit 320 is coupled to the current detection terminals ISEN1, ISEN2, ISENN and the pulse width modulation terminal PWM. The current sensing and balancing circuit 320 controls the operating modes of the multiple MOS transistors (e.g., MOS transistors $Q_1, Q_2, \ldots, Q_N$) according to the dimming signal, balances the LED currents $I_1, I_2, \ldots, I_N$, and also generates a current feedback signal $S_{ISEN}$ according to the LED currents $I_1, I_2, \ldots, I_N$. The MOS transistors are coupled to the light source 104.

The operating modes of multiple MOS transistors (e.g., MOS transistors $Q_1, Q_2, \ldots, Q_N$) include a linear mode and a switch mode. When the preset brightness is in a first brightness range, the current sensing and balancing circuit 320 controls the multiple MOS transistors to operate in the linear mode. When the preset brightness is in a second brightness range, the current sensing and balancing circuit 320 controls the multiple MOS transistors to operate in the switch mode. The first brightness range and the second brightness range can be specified by design and/or set by a user. The details are described below. By changing the operating modes of the multiple MOS transistors according to the preset brightness of the light source 104, the power consumed by the multiple MOS transistors (e.g., MOS transistors $Q_1, Q_2, \ldots, Q_N$) can be reduced and the power efficiency can be improved.

In an embodiment, the current sensing and balancing circuit 320 includes a selector 321, a switch control unit 322, an integrating circuit 323, and a comparator EA6, or the like (refer to FIG. 3 for the specific circuit and the connection relationships of the current sensing and balancing circuit 320). In FIG. 3, the resistance values of sensing resistors $R_{S1}, R_{S2}, \ldots, R_{SN}$ are equal. From FIG. 3, the LED current $I_j=(V_{OUT}-V_{Fj})/R_S$ (formula 1), where $V_{Fj}$ represents a voltage value at the LED string Sj, and $R_S$ represents a resistance value of the sensing resistor $R_{Sj}$. The conditions (e.g., resistance values, temperature, or the like) of each LED string can be different, and so the voltage values $V_{F1}, V_{F2}, \ldots, V_{FN}$ at the LED strings S1, S2, . . . , SN may not be equal. Therefore, the amount of the LED currents $I_1, I_2, \ldots, I_N$ may not be equal. The current sensing and balancing circuit 320 controls the operating modes of the multiple MOS transistors (e.g., MOS transistors $Q_1, Q_2, \ldots, Q_N$) and balances the LED currents $I_1, I_2, \ldots, I_N$ according to the dimming signal indicative of the preset brightness of the light source 104. Thus, any differences among current values of the LED currents $I_1, I_2, \ldots, I_N$ are relatively small and can be ignored.

In an embodiment, if the preset brightness is in the first brightness range (e.g., 60% to 100% of the total brightness), the integrating circuit 323 integrates the dimming signal to generate a voltage signal $V_5$. In an embodiment, if the preset brightness indicated by the dimming signal is 60% of the total brightness, the voltage value of the voltage signal $V_5$ is 1.8V. If the preset brightness indicated by the dimming signal is 100% of the total brightness, the voltage value of the voltage signal $V_5$ is 3V. In other words, when the preset brightness indicated by the dimming signal is between 60% and 100% of the total brightness, the voltage value of the voltage signal $V_5$ is between 1.8V and 3V. If a comparator EA6 determines that the voltage value of the voltage signal $V_5$ is not less than a preset voltage value $V_4$ (e.g., $V_4$=1.8V), it can be determined that the preset brightness indicated by the dimming signal is between 60% and 100% of the total brightness. Then, the switches $S_{11}, S_{12}, \ldots, S_{1N}$ are turned on and the switches $S_{21}, S_{22}, \ldots, S_{2N}$ are turned off under the control of the switch control unit 322. Under the conditions just described in this paragraph, the MOS transistors $Q_1, Q_2, \ldots, Q_N$ operate in the linear mode.

In the linear mode, the resistance values of the MOS transistors $Q_1, Q_2, \ldots, Q_N$ can be continuously adjusted. A terminal of a buffer $BF_j$ is connected to the sensing resistor $R_{Sj}$ to receive a sensing voltage $V_{Sj}$ (j=1, 2, . . . , N) across the sensing resistor $R_{Sj}$, and the other terminal of the buffer $BF_j$ is connected to a reference signal generator (not shown in the figure) to receive a balancing reference voltage generated by the reference signal generator. If the sensing voltage $V_{Sj}$ is greater than the balancing reference voltage, a voltage applied by the buffer $BF_j$ on a gate of the MOS transistor $Q_j$ is reduced. Then, the resistance value $R_{Qj}$ of the MOS transistor $Q_j$ is increased and the LED current $I_j$ is reduced, j=1, 2, . . . , N. If the sensing voltage $V_{Sj}$ is less than the balancing reference voltage, the voltage applied by the buffer $BF_j$ on the gate of the MOS transistor $Q_j$ is increased. Then, the resistance value $R_{Qj}$ of the MOS transistor $Q_j$ is reduced and the LED current $I_j$ is increased. In an embodiment, the balancing reference voltage can be an average current value indicative of the LED currents $I_1, I_2, \ldots, I_N$; however, the invention is not so limited.

In addition, the selector 321 selects the current feedback signal $S_{ISEN}$ according to indicating voltages $V_{IN1}, V_{IN2}, \ldots, V_{INN}$ indicative of the balanced LED currents $I_1', I_2', \ldots, I_N'$, respectively, where $V_{INj}=I_j'(R_S+R_{Qj})$ (j=1, 2, . . . , N) (formula 2). From the formulas (1) and (2), the smaller the value of the indicating voltage $V_{INj}$, the smaller the amount of the LED current $I_j$. In an embodiment, the current feedback signal $S_{ISEN}$ is the minimum value of the indicating voltages $V_{IN1}, V_{IN2}, \ldots, V_{INN}$.

In an embodiment, if the preset brightness is in the second brightness range (e.g., 10% to 60% of the total brightness), the integrating circuit 323 integrates the dimming signal to generate the voltage signal $V_5$. In an embodiment, if the preset brightness indicated by the dimming signal is 60% of the total brightness, the voltage value of the voltage signal $V_5$ is 1.8V. If the preset brightness indicated by the dimming signal is 10% of the total brightness, the voltage value of the voltage signal $V_5$ is 0.3V. In other words, when the preset brightness indicated by the dimming signal is between 10% and 60% of the total brightness, the voltage value of the voltage signal $V_5$ is between 0.3V and 1.8V. If the comparator EA6 determines that the voltage value of the voltage signal $V_5$ is less than the preset voltage value $V_4$ (e.g., $V_{4=1.8}$V), it can be determined that the preset brightness indicated by the dimming signal is between 10% and 60% of the total brightness. Then, the switches $S_{11}, S_{12}, \ldots, S_{1N}$ are turned off and the switches $S_{21}, S_{22}, \ldots, S_{2N}$ are turned on under the control of the switch control unit 322. Under the conditions just described in this paragraph, the MOS transistors $Q_1, Q_2, \ldots, Q_N$ operate in the switch mode.

In the switch mode, the MOS transistors $Q_1, Q_2, \ldots, Q_N$ can be turned on or be turned off. If the sensing voltage $V_{Sj}$ is greater than the balancing reference voltage, then a signal generator PWMj reduces the duty cycle of a signal PWMj', and a time period during which the MOS transistor $Q_j$ is turned on is reduced, thus reducing the amount of the LED current $I_j$, j=1, 2, . . . , N. If the sensing voltage $V_{Sj}$ is less than the balancing reference voltage, then the signal generator PWMj increases the duty cycle of the signal PWMj', and the time period during which the MOS transistor $Q_j$ is turned on is increased, thus increasing the amount of the LED current $I_j$. The term "the duty cycle of the signal PWMj''' represents a ratio of a length of a time period during which a high level lasts to a length of a time period of an entire cycle (referred to herein as an alternation cycle). The time period during which the high level lasts is also the time period during which the MOS transistor $Q_j$ is turned on. The balancing reference voltage can be the average current value indicative of the LED currents $I_1, I_2, \ldots, I_N$; however, the invention is not so limited.

In addition, before the LED currents $I_1, I_2, \ldots, I_N$ are balanced, the selector 321 selects the current feedback signal $S_{ISEN}$ according to the sensing voltages $V_{S1}, V_{S2}, \ldots, V_{SN}$ across the sensing resistors $R_{S1}, R_{S2}, \ldots, R_{SN}$, respectively. In an embodiment, the current feedback signal $S_{ISEN}$ is the minimum value among the sensing voltages $V_{S1}, V_{S2}, \ldots, V_{SN}$.

The comparison and feedback circuit 310 is coupled to the voltage detection terminal 311 and to the current sensing and balancing circuit 320. The comparison and feedback circuit 310 generates the first adjusting current $I_{ADJF1}$ indicative of the second output voltage $V_S$, to enable the second output voltage $V_S$ in the preset voltage range. When the second output voltage $V_S$ is in the preset voltage range, the comparison and feedback circuit 310 generates the second adjusting current $I_{ADJF2}$ according to a difference between the LED currents $I_1, I_2, \ldots, I_N$ and the target current value, to enable the LED currents $I_1, I_2, \ldots, I_N$ to maintain the target current value. The first adjusting current $I_{ADJF1}$ is generated prior to the second adjusting current $I_{ADJF2}$.

More specifically, the comparison and feedback circuit 310 is coupled to the high clamp terminal HCP, the low clamp terminal LCP, and the current sensing and balancing circuit 320. Because both the first monitoring voltage $V_1$ and the second monitoring voltage $V_2$ are received before the LED currents $I_1, I_2 \ldots, I_N$, the comparison and feedback circuit 310 generates the first adjusting current $I_{ADJF1}$ according to both the relationship between the first monitoring voltage $V_1$ and the low voltage threshold $V_{SL}$ and the relationship between the second monitoring voltage $V_2$ and the high voltage threshold $V_{SH}$, to enable the second output voltage $V_S$ in the preset voltage range. When the second output voltage $V_S$ is in the preset voltage range, the comparison and feedback circuit 310 generates the second adjusting current $I_{ADJF2}$ according to the difference between the current feedback signal $S_{ISEN}$ (indicative of the LED currents $I_1, I_2 \ldots, I_N$) and the current reference signal $S_{ADJ}$ (indicative of the target current value), to enable the LED currents $I_1, I_2, \ldots, I_N$ to maintain the target current value. Both the low voltage threshold $V_{SL}$ and the high voltage threshold $V_{SH}$ are generated by the reference signal generator (not shown in the figure).

In an embodiment, $V_{SL}=V_{TH1}\neq(R_6+R_7)/(R_5+R_6+R_7)$, and $V_{SH}=V_{TH2}\cdot R_7/(R_5+R_6+R_7)$, where $V_{TH1}$ is the minimum of the second output voltage $V_S$ in the preset voltage range, and $V_{TH2}$ is the maximum of the second output voltage $V_S$ in the preset voltage range; however, the present invention is not so limited. The preset voltage range of the second output voltage $V_S$ can be determined according to both the relationship between the first monitoring voltage $V_1$ and the low voltage threshold $V_{SL}$ and the relationship between the second monitoring voltage $V_2$ and the high voltage threshold $V_{SH}$.

In an embodiment, the comparison and feedback circuit 310 includes a comparator EA1, a comparator EA2, a comparator EA3, a comparator EA4, a first logic circuit 313, a second logic circuit 314, and a conversion unit 315. A non-inverting input terminal of the comparator EA1 receives the low voltage threshold $V_{SL}$, an inverting input terminal of the comparator EA1 is coupled to the low clamp terminal LCP to receive the first monitoring voltage $V_1$, and an output terminal of the comparator EA1 outputs a first comparison result. The first comparison result is generated by the comparator EA1 according to the first monitoring voltage $V_1$ and the low voltage threshold $V_{SL}$. If the first monitoring voltage $V_1$ is not less than the low voltage threshold $V_{SL}$, the first comparison result is at a low level. If the first monitoring voltage $V_1$ is less than the low voltage threshold $V_{SL}$, the first comparison result is at a high level.

A non-inverting input terminal of the comparator EA2 is coupled to the high clamp terminal HCP to receive the second monitoring voltage $V_2$, an inverting input terminal of the comparator EA2 receives the high voltage threshold $V_{SH}$, and an output terminal of the comparator EA2 outputs a second comparison result. The second comparison result is generated by the comparator EA2 according to the second monitoring voltage $V_2$ and the high voltage threshold $V_{SH}$. If the second monitoring voltage $V_2$ is not greater than the high voltage threshold $V_{SH}$, the second comparison result is at a low level. If the second monitoring voltage $V_2$ is greater than the high voltage threshold $V_{SH}$, the second comparison result is at a high level.

A non-inverting input terminal of the comparator EA3 receives the current reference signal $S_{ADJ}$ generated by the reference signal generator (not shown in the figure), an inverting input terminal of the comparator EA3 is coupled to the current sensing and balancing circuit 320 to receive the current feedback signal $S_{ISEN}$, and an output terminal of the comparator EA3 outputs a third comparison result. The third comparison result is generated by the comparator EA3 according to the current reference signal $S_{ADJ}$ and the current feedback signal $S_{ISEN}$. For example, if the current reference signal $S_{ADJ}$ is greater than the current feedback signal $S_{ISEN}$, the third comparison result is at a high level. If the current reference signal $S_{ADJ}$ is not greater than the current feedback signal $S_{ISEN}$, the third comparison result is at a low level. In an embodiment, the current reference signal $S_{ADJ}$ indicates the target current value of the LED currents $I_1, I_2, \ldots, I_N$.

A non-inverting input terminal of the comparator EA4 is coupled to the current sensing and balancing circuit 320 to receive the current feedback signal $S_{ISEN}$, an inverting input terminal of the comparator EA4 receives the current reference signal $S_{ADJ}$ generated by the reference signal generator (not shown in the figure), and an output terminal of the comparator EA4 outputs a fourth comparison result. The fourth comparison result is generated by the comparator EA4 according to the current reference signal $S_{ADJ}$ and the current feedback signal $S_{ISEN}$. For example, if the current feedback signal $S_{ISEN}$ is greater than the current reference signal $S_{ADJ}$, the fourth comparison result is at a high level. If the current feedback signal $S_{ISEN}$ is not greater than the current reference signal $S_{ADJ}$, the fourth comparison result is at a low level.

The first logic circuit 313 is coupled to the output terminal of the comparator EA1, receives the first comparison result, and selectively outputs a first add signal. For example, when the first comparison result is at a high level, the first logic circuit 313 outputs the first add signal. The first logic circuit 313 is also coupled to the output terminal of the comparator EA3, receives the third comparison result, and selectively outputs a second add signal. For example, when the third comparison result is at a high level, the first logic circuit 313 outputs the second add signal. Because the first monitoring voltage $V_1$ is received before the LED currents $I_1, I_2, \ldots, I_N$, the first comparison result is output before the third comparison result. In other words, the first comparison result is received prior to the third comparison result. Then, the first logic circuit 313 receives the first comparison result, and selectively outputs the first add signal according to the first comparison result, to enable the second output voltage $V_S$ in the preset voltage range. When the second output voltage $V_S$ is in the preset voltage range, the first logic circuit 313 receives the third comparison result, and then selectively outputs the second add signal according to the third comparison result.

The second logic circuit 314 is coupled to the output terminal of the comparator EA2, receives the second comparison result, and selectively outputs a first minus signal. For example, when the second comparison result is at a high level, the second logic circuit 314 outputs the first minus signal. The second logic circuit 314 is coupled to the output terminal of the comparator EA4, receives the fourth comparison result, and selectively outputs a second minus signal. For example, when the fourth comparison result is at a high level, the second logic circuit 314 outputs the second minus signal. Because the second monitoring voltage $V_2$ is received before the LED currents $I_1, I_2, \ldots, I_N$, the second comparison result is output before the fourth comparison result. In other words, the second comparison result is received prior to the fourth comparison result. So the second logic circuit 314 receives the second comparison result, and selectively outputs the first minus signal according to the second comparison result, to enable the second output voltage $V_S$ in the preset voltage range. When the second output voltage $V_S$ is in the preset voltage range, the second logic circuit 314 receives the fourth comparison result, and then selectively outputs the second minus signal according to the fourth comparison result.

The conversion unit 315 is coupled to the first logic circuit 313 and the second logic circuit 314. Because both the first monitoring voltage $V_1$ and the second monitoring voltage $V_2$ are received before the LED currents $I_1, I_2, \ldots, I_N$, both the first add signal and the first minus signal are output before the second add signal and the second minus signal. Then, the conversion unit 315 generates the first adjusting current $I_{ADJF1}$ according to the first add signal or the first minus signal, to enable the second output voltage $V_S$ in the preset voltage range. When the second output voltage $V_S$ is in the preset voltage range, the conversion unit 315 generates the second adjusting current $I_{ADJF2}$ according to the second add signal or the second minus signal, to enable the LED currents $I_1, I_2, \ldots, I_N$ to maintain the target current value. The first adjusting current $I_{ADJF1}$ flows from the voltage sensing circuit 230 to the conversion unit 315 according to the first add signal, to reduce the voltage sensing signal $V_{SEN}$. The first adjusting current $I_{ADJF1}$ flows from the conversion unit 315 to the voltage sensing circuit 230 according to the first minus signal, to increase the voltage sensing signal $V_{SEN}$. The second adjusting current $I_{ADJF2}$ flows from the voltage sensing circuit 230 to the conversion unit 315 according to the second add signal, to reduce the adjusted voltage sensing signal $V_{SEN}$. The second adjusting current $I_{ADJF2}$ flows from the conversion unit 315 to the voltage sensing circuit 230 according to the second minus signal, to increase the adjusted voltage sensing signal $V_{SEN}$. In an embodiment, the second adjusting current $I_{ADJF2}$ indicates the difference between the current feedback signal $S_{ISEN}$ and the current reference signal $S_{ADJ}$.

In an embodiment, the conversion unit 315 includes a register and a digital-to-analog converter. The register stores the first add signal, the second add signal, the first minus signal, and the second minus signal in the form of digital signals. The digital-to-analog converter generates the first adjusting current $I_{ADJF1}$ according to the first add signal or the first minus signal in the form of a digital signal. The digital-to-analog converter also generates the second adjusting current $I_{ADJF2}$ according to the second add signal or the second minus signal in the form of a digital signal.

The below three cases show that the second output voltage $V_S$ can be determined to be in the preset voltage range by the relationship between the first monitoring voltage $V_1$ and the low voltage threshold $V_{SL}$ and by the relationship between the second monitoring voltage $V_2$ and the high voltage threshold $V_{SH}$.

In the first case, when the comparator EA1 determines that the first monitoring voltage $V_1$ is not less than the low voltage threshold $V_{SL}$ (e.g., the comparator EA1 outputs a low level) and the comparator EA2 determines that the second monitoring voltage $V_2$ is not greater than the high voltage threshold $V_{SH}$ (e.g., the comparator EA2 outputs a low level), the first logic circuit 313 does not output the first add signal and the second logic circuit 314 does not output the first minus signal. Consequently, the conversion unit 315 does not generate the first adjusting current $I_{ADJF1}$ ($I_{ADJF1}=0$). For example, $V_1=V_S\cdot(R_6+R_7)/(R_5+R_6+R_7)$ (formula 3), $V_{SL}=V_{TH1}\cdot(R_6+R_7)/(R_5+R_6+R_7)$ (formula 4), $V_2=V_S\cdot R_7/(R_5+R_6+R_7)$ (formula 5), and $V_{SH}=V_{TH2}\cdot R_7/(R_5+R_6+R_7)$ (formula 6), where $V_{TH1}$ is the minimum of the second output voltage $V_S$ in the preset voltage range, and $V_{TH2}$ is the maximum of the second output voltage $V_S$ in the preset voltage range. If $V_1 \geqslant V_{SL}$, $V_2 \leqslant V_{SH}$, then from the above formulas (3), (4), (5), and (6), $V_S \geqslant V_{TH1}$, $V_S \leqslant V_{TH2}$. Because $V_{TH1} \leqslant V_{TH2}$, then $V_{TH1} \leqslant V_S \leqslant V_{TH2}$. Therefore, if $V_1 \geqslant V_{SL}$, $V_2 \leqslant V_{SH}$, then $V_{TH1} \leqslant V_S \leqslant V_{TH2}$.

In the second case, when the comparator EA1 determines that the first monitoring voltage $V_1$ is less than the low voltage threshold $V_{SL}$ (e.g., the comparator EA1 outputs a high level) and the comparator EA2 determines that the second monitoring voltage $V_2$ is not greater than the high voltage threshold $V_{SH}$ (e.g., the comparator EA2 outputs a low level), the first logic circuit 313 outputs the first add signal and the second logic circuit 314 does not output the first minus signal. Then, the conversion unit 315 generates the first adjusting current $I_{ADJF1}$, and the first adjusting current $I_{ADJF1}$ flows from the voltage sensing circuit 230 to the conversion unit 315 ($I_{ADJF1}<0$), to increase the second output voltage $V_S$, thus enabling the second output voltage $V_S$ in the preset voltage range. For example, $V_1=V_S\cdot(R_6+R_7)/(R_5+R_6+R_7)$ (formula 7), $V_{SL}=V_{TH1}\cdot(R_6+R_7)/(R_5+R_6+R_7)$ (formula 8), $V_2=V_S\cdot R_7/(R_5+R_6+R_7)$ (formula 9), and $V_{SH}=V_{TH2}\cdot R_7/(R_5+R_6+R_7)$ (formula 10), where $V_{TH1}$ is the minimum of the second output voltage $V_S$ in the preset voltage range, and $V_{TH2}$ is the maximum of the second output voltage $V_S$ in the preset voltage range. If $V_1<V_{SL}$, $V_2 \leqslant V_{SH}$, then from the above formulas (7), (8), (9), and (10), $V_S<V_{TH1}$, $V_S \leqslant V_{TH2}$. Because $V_{TH1} \leqslant V_{TH2}$, then $V_S<V_{TH1}$. Therefore, if $V_1<V_{SL}$, $V_2 \leqslant V_{SH}$, then $V_S<V_{TH1}$. Because the first adjusting current $I_{ADJF1}$ flows from the voltage sensing circuit 230 to the conversion unit 315, the second output voltage $V_S$ is increased until the second output voltage $V_S$ is in the preset voltage range.

In the third case, when the comparator EA1 determines that the first monitoring voltage $V_1$ is not less than the low voltage threshold $V_{SL}$ (e.g., the comparator EA1 outputs a low level) and the comparator EA2 determines that the second monitoring voltage $V_2$ is greater than the high voltage threshold $V_{SH}$ (e.g., the comparator EA2 outputs a high level), the first logic circuit 313 does not output the first add signal and the second logic circuit 314 outputs the first minus signal. Then, the conversion unit 315 generates the first adjusting current $I_{ADJF1}$, and the first adjusting current $I_{ADJF1}$ flows from the conversion unit 315 to the voltage sensing circuit 230 ($I_{ADJF1}>0$), to reduce the second output voltage $V_S$, thus enabling the second output voltage $V_S$ in the preset voltage range. For example, $V_1=V_S\cdot(R_6+R_7)/(R_5+R_6+R_7)$ (formula 11), $V_{SL}=V_{TH1}\cdot(R_6+R_7)/(R_5+R_6+R_7)$ (formula 12), $V_2=V_S\cdot R_7/(R_5+R_6+R_7)$ (formula 13), $V_{SH}=V_{TH2}\cdot R_7/(R_5+R_6+R_7)$ (formula 14), where $V_{TH1}$ is the minimum of the second output voltage $V_S$ in the preset voltage range, and $V_{TH2}$ is the maximum of the second output voltage $V_S$ in the preset voltage range. If $V_1 \geqslant V_{SL}$, $V_2>V_{SH}$, then from the above formulas (11), (12), (13), and (14), $V_S \geqslant V_{TH1}$, $V_S>V_{TH2}$. Because $V_{TH1} \leqslant V_{TH2}$, then $V_S>V_{TH2}$. Therefore, if $V_1 \geqslant V_{SL}$, $V_2>V_{SH}$, then $V_S>V_{TH2}$. Because the first adjusting current $I_{ADJF1}$ flows from the conversion unit 315 to the voltage sensing circuit 230, the second output voltage $V_S$ is reduced until the second output voltage $V_S$ is in the preset voltage range.

When the second output voltage $V_S$ is in the preset voltage range, according to the relationship between the current feedback signal $S_{ISEN}$ (indicative of the LED currents $I_1, I_2, \ldots, I_N$) and the current reference signal $S_{ADJ}$ (indicative of the target current value), it can be determined whether the LED currents $I_1, I_2, \ldots, I_N$ are the target current value. The details are described below.

If the current feedback signal $S_{ISEN}$ is greater than the current reference signal $S_{ADJ}$, the comparator EA3 outputs a low level and the comparator EA4 outputs a high level. Consequently, the first logic circuit 313 does not output the second add signal, and the second logic circuit 314 outputs the second minus signal. The conversion unit 315 generates the second adjusting current $I_{ADJF2}$ according to the second minus signal. The second adjusting current $I_{ADJF2}$ ($I_{ADJF2}>0$) flows from the conversion unit 315 to the voltage sensing circuit 230 to reduce the first output voltage $V_{OUT}$, thereby enabling the LED currents $I_1, I_2, \ldots, I_N$ to decrease to the target current value.

If the current feedback signal $S_{ISEN}$ is less than the current reference signal $S_{ADJ}$, the comparator EA3 outputs a high level and the comparator EA4 outputs a low level. Then, the first logic circuit 313 outputs the second add signal, and the second logic circuit 314 does not output the second minus signal. The conversion unit 315 generates the second adjusting current $I_{ADJF2}$ according to the second add signal. The second adjusting current $I_{ADJF2}$ ($I_{ADJF1}<0$) flows from the voltage sensing circuit 230 to the conversion unit 315 to increase the first output voltage $V_{OUT}$, thereby enabling the LED currents $I_1, I_2, \ldots, I_N$ to increase to the target current value.

If the current feedback signal $S_{ISEN}$ is equal to the current reference signal $S_{ADJ}$, the comparator EA3 outputs a low level, and the comparator EA4 outputs a low level. The first logic circuit 313 does not output the second add signal and the second logic circuit 314 does not output the second minus signal. Consequently, the conversion unit 315 does not generate the second adjusting current $I_{ADJF2}$ ($I_{ADJF2}=0$). As such, the LED currents $I_1, I_2, \ldots, I_N$ is maintained at the target current value.

The adjusting terminal ADJF is coupled to the voltage sensing circuit 230. The adjusting terminal ADJF transfers the first adjusting current $I_{ADJF1}$ and the second adjusting current $I_{ADJF2}$, to adjust the voltage sensing signal $V_{SEN}$. The adjusting terminal ADJF is an input/output terminal (e.g., a bidirectional terminal). In other words, both the first adjusting current $I_{ADJF1}$ and the second adjusting current $I_{ADJF2}$ not only flow from the controller 220 to the voltage sensing circuit 230 through the adjusting terminal ADJF, but also can flow from the voltage sensing circuit 230 to the controller 220 through the adjusting terminal ADJF.

The shunt regulator 330 is connected to the voltage sensing circuit 230 through the voltage sensing terminal $V_{SEN}$ to receive the voltage sensing signal $V_{SEN}$ (which may be the unadjusted voltage sensing signal $V_{SEN}$, the adjusted voltage sensing signal $V_{SEN}$, or the twice-adjusted voltage sensing signal $V_{SEN}$, similarly hereinafter in this paragraph); and is connected to the optical coupler 240 through the control terminal CMPO to output the control current $I_{CMPO}$ (which may be the first control current $I_{CMPO1}$, the second control current $I_{CMPO2}$, or the third control current $I_{CMPO3}$, similarly hereinafter in this paragraph). The shunt regulator 330 generates the control current $I_{CMPO}$ according to a difference between the voltage sensing signal $V_{SEN}$ and the voltage reference signal $V_{REF}$. More specifically, the shunt regulator 330 generates the first control current $I_{CMPO1}$ according to the difference between the adjusted voltage sensing signal $V_{SEN}$ and the voltage reference signal $V_{REF}$. The shunt regulator 330 generates the second control current $I_{CMPO2}$ according to the difference between the twice-adjusted voltage sensing signal $V_{SEN}$ and the voltage reference signal $V_{REF}$. The shunt regulator 330 generates the third control current $I_{CMPO3}$ according to the difference between the unadjusted voltage sensing signal $V_{SEN}$ and the voltage reference signal $V_{REF}$.

In an embodiment, the shunt regulator 330 includes an error amplifier EA5 and a MOS transistor M2. A non-inverting input terminal of the error amplifier EA5 is coupled to the voltage sensing terminal $V_{SEN}$ to receive the voltage sensing signal $V_{SEN}$ (which may be the unadjusted voltage sensing signal $V_{SEN}$, the adjusted voltage sensing signal $V_{SEN}$, or and the twice-adjusted voltage sensing signal $V_{SEN}$, similarly hereinafter in this paragraph), an inverting input terminal of the error amplifier EA5 receives the voltage reference signal $V_{REF}$ transmitted by a reference signal generator (not shown in the figure), and an output terminal of the error amplifier EA5 outputs an error signal. The error signal is generated by the error amplifier EA5 according to a difference between the voltage sensing signal $V_{SEN}$ and the voltage reference signal $V_{REF}$. A gate of the MOS transistor M2 is coupled to the output terminal of the error amplifier EA5 to receive the error signal, a source of the MOS transistor M2 is connected to a ground, and a drain of the MOS transistor M2 is connected to the control terminal CMPO to generate the control current $I_{CMPO}$ (which may be the first control current $I_{CMPO1}$, the second control current $I_{CMPO2}$, or the third control current $I_{CMPO3}$, similarly hereinafter in this paragraph). Because the MOS transistor M2 operates in a variable resistance region, then the larger a voltage applied to the gate of the MOS transistor M2, the smaller the resistance value of the MOS transistor M2. In an embodiment, if the voltage sensing signal $V_{SEN}$ is less than the voltage reference signal $V_{REF}$, then the voltage value of the error signal is increased, and the resistance value of the MOS transistor M2 is reduced. Therefore, the control current $I_{CMPO}$ flowing through the MOS transistor M2 is increased. If the voltage sensing signal $V_{SEN}$ is greater than the voltage reference signal $V_{REF}$, then the voltage value of the error signal is reduced, and the resistance value of the MOS transistor M2 is increased. Therefore, the control current $I_{CMPO}$ flowing through the MOS transistor M2 is reduced. The control current $I_{CMPO}$ flows through the MOS transistor M2 from the optical coupler 240 to the ground. In the embodiment, the error amplifier EA5 is an operational amplifier.

More specifically, before the voltage sensing signal $V_{SEN}$ (the unadjusted voltage sensing signal $V_{SEN}$) is adjusted by the first adjusting current $I_{ADJF1}$ and the second adjusting current $I_{ADJF2}$, the unadjusted voltage sensing signal $V_{SEN}$ is linearly proportional to the first output voltage $V_{OUT}$, e.g., $V_{SEN}=V_{OUT}\cdot R_2/(R_2+R_8)$, where $R_2$ represents the resistance value of the resistor R2, and R8 represents the resistance value of the resistor R8. The shunt regulator 330 generates the third control current $I_{CMPO3}$ according to the difference between the unadjusted voltage sensing signal $V_{SEN}$ and the voltage reference signal $V_{REF}$. The optical coupler 240 generates the third control signal $S_3$ according to the third control current $I_{CMPO3}$, to enable the power converter 103 to reduce the difference between the unadjusted voltage sensing signal $V_{SEN}$ and the voltage reference signal $V_{REF}$ by increasing or reducing the first output voltage $V_{OUT}$. Therefore, before the voltage sensing signal $V_{SEN}$ (the unadjusted voltage sensing signal $V_{SEN}$) is adjusted by the first adjusting current $I_{ADJF1}$ and the second adjusting current $I_{ADJF2}$, the unadjusted voltage sensing signal $V_{SEN}$ can be adjusted to the voltage reference signal $V_{REF}$ (e.g., $V_{SEN}=V_{REF}$). The first output voltage $V_{OUT}$ can be adjusted to a target voltage value $V_{TARGET}$ determined by the voltage reference signal $V_{REF}$, e.g., $V_{OUT}=V_{TARGET}=V_{REF}\cdot(R_2+R_8)/R_2$.

If the first monitoring voltage $V_1$ is not less than the low voltage threshold $V_{SL}$ and the second monitoring voltage $V_2$ is greater than the high voltage threshold $V_{SH}$, the first adjusting current $I_{ADJF1}$ ($I_{ADJF1}>0$) flows into the voltage sensing circuit 230 to increase the voltage sensing signal $V_{SEN}$ (the unadjusted voltage sensing signal $V_{SEN}$). The first control current $I_{CMPO1}$ generated by the shunt regulator 330 is reduced according to the increased voltage sensing signal $V_{SEN}$ (the adjusted voltage sensing signal $V_{SEN}$). The optical coupler 240 generates the first control signal $S_1$ in a first state (e.g., a low level) after the first control current $I_{CMPO1}$ is reduced. The power converter 103 reduces the second output voltage $V_S$ according to the first control signal $S_1$ in the first state (e.g., a low level), to enable the second output voltage $V_S$ in the preset voltage range. If the first monitoring voltage $V_1$ is less than the low voltage threshold $V_{SL}$ and the second monitoring voltage $V_2$ is not greater than the high voltage threshold $V_{SH}$, then the first adjusting current $I_{ADJF1}$ ($I_{ADJF1}<0$) flows into the controller 220 to reduce the voltage sensing signal $V_{SEN}$ (the unadjusted voltage sensing signal $V_{SEN}$). The first control current $I_{CMPO1}$ generated by the shunt regulator 330 is increased according to the reduced voltage sensing signal $V_{SEN}$ (the adjusted voltage sensing signal $V_{SEN}$). The optical coupler 240 generates the first control signal $S_1$ in a second state (e.g., a high level) after the first control current $I_{CMPO1}$ is increased. The power converter 103 increases the second output voltage $V_S$ according to the first control signal $S_1$ in the second state (e.g., a high level), to enable the second output voltage $V_S$ in the preset voltage range. If the first monitoring voltage $V_1$ is not less than the low voltage threshold $V_{SL}$ and the second monitoring voltage $V_2$ is not greater than the high voltage threshold $V_{SH}$, the first adjusting current $I_{ADJF1}$ is not generated ($I_{ADJF1}=0$), which indicates the second output voltage $V_S$ is in the preset voltage range. Under the conditions just described in this paragraph, the second output voltage $V_S$ in the preset voltage range is compatible with a variety of displays. Thus, embodiments according to the invention eliminate the need for a matching circuit that is designed according to the type of displays, and designs according to the invention are more generic.

When the second output voltage $V_S$ is in the preset voltage range, if the current feedback signal $S_{ISEN}$ is greater than the current reference signal $S_{ADJ}$, the second adjusting current $I_{ADJF2}$ ($I_{ADJF2}>0$) flows into the voltage sensing circuit 230 to increase the adjusted voltage sensing signal $V_{SEN}$. The second control current $I_{CMPO2}$ generated by the shunt regulator 330 is reduced after the adjusted voltage sensing signal $V_{SEN}$ is increased. The optical coupler 240 generates the second control signal $S_2$ in the first state (e.g., a low level) after the second control current $I_{CMPO2}$ is reduced, to reduce the first output voltage $V_{OUT}$ (e.g., to enable the first output voltage $V_{OUT}$ less than the above target voltage value), thereby enabling the LED currents $I_1, I_2, \ldots, I_N$ to maintain the target current value. If the current feedback signal $S_{ISEN}$ is less than the current reference signal $S_{ADJ}$, the second adjusting current $I_{ADJF2}$ ($I_{ADJF2}<0$) flows into the controller 220 to reduce the adjusted voltage sensing signal $V_{SEN}$. The second control current $I_{CMPO2}$ generated by the shunt regulator 330 is increased after the adjusted voltage sensing signal $V_{SEN}$ is reduced. The optical coupler 240 generates the second control signal $S_2$ in the second state (e.g., a high level) after the second control current $I_{CMPO2}$ is increased, to increase the first output voltage $V_{OUT}$ (e.g., to enable the first output voltage $V_{OUT}$ greater than the above target voltage value), thereby enabling the LED currents $I_1, I_2, \ldots, I_N$ to increase to the target current value. If the current feedback signal $S_{ISEN}$ is equal to the current reference signal $S_{ADJ}$, the second control current $I_{CMPO2}$ generated by the controller 220 is zero ($I_{ADJF2}=0$), which indicates the LED currents $I_1, I_2, \ldots, I_N$ are equal to the target current value. Under the conditions just described in this paragraph, the power consumption of the light source 104 is reduced and power efficiency is improved.

The driver 340 is coupled to an enable terminal ENA of the controller 220, and generates a driving signal according to a voltage signal. The enable terminal ENA generates the voltage signal when the light source 104 is lit. The load unit 250 is turned on for a preset time period according to the driving signal, to reduce the first output voltage $V_{OUT}$. In an embodiment, when the light source 104 is lit, the enable terminal ENA generates the voltage signal (e.g., a high level). Then, the driver 340 generates the driving signal in a first state (e.g., a high level) according to the voltage signal. The MOS transistor M1 is turned on for the preset time period according to the driving signal in the first state. In the preset time period, the first output voltage $V_{OUT}$ is reduced after the resistor R1 is applied to the first output voltage $V_{OUT}$. The reduced first output voltage $V_{OUT}$ will not cause the light source 104 to flicker or be burnt out. When the MOS transistor M1 is turned on for the preset time period, the driver 340 generates the driving signal in a second state (e.g., a low level), and the MOS transistor M1 is turned off. The controller 220 can adjust the first output voltage $V_{OUT}$ after the light source 104 is lit, to prevent the first output voltage $V_{OUT}$ from being too large. Therefore, the system 200 can protect the light source 104 and reduce power consumption, by turning off the MOS transistor M1 in the preset time period after the light source 104 is lit.

The voltage protection terminal OVP is coupled to the voltage protection unit 260 to receive the third monitoring voltage $V_3$. The driver 340 performs protection operations according to the third monitoring voltage $V_3$. The driver 340 is also connected to the selector 321 (the connection relationship is not shown in FIG. 3).

Specifically, if one or some LED strings in the LED strings S1, S2, . . . , SN are in an open circuit state, and if the LED current $I_j$ of the LED string Sj in the open circuit state is the minimum (e.g., zero amperes), then the indicating voltage $V_{INj}$ indicative of the LED current $I_j$ or the sensing voltage $V_{Sj}$ indicative of the LED current $I_j$ is also in the minimum state. The selector 321 selects the indicating voltage $V_{INj}$ or the sensing voltage $V_{Sj}$ as the current feedback signal $S_{ISEN}$, resulting in a continuous increase of the first output voltage $V_{OUT}$. When the third monitoring voltage $V_3$ is not less than a first preset voltage $V_{SET1}$ but less than a second preset voltage $V_{SET2}$ ($V_{SET1} \leqslant V_3 < V_{SET2}$), the selector 321 does not select the indicating voltage $V_{INj}$ or the sensing voltage $V_{Sj}$ as the current feedback signal $S_{ISEN}$ under the control of the driver 340, thus preventing the continuous increase of the first output voltage $V_{OUT}$. If all of the LED strings S1, S2, . . . , SN are in the open circuit state, the selector 321 can select the LED current $I_j$ of the LED string Sj in the open circuit state as the current feedback signal $S_{ISEN}$, resulting in the continuous increase of the first output voltage $V_{OUT}$. When the third monitoring voltage $V_3$ is not less than the second preset voltage $V_{SET2}$ but less than a third preset voltage $V_{SET3}$ ($V_{SET2} \leqslant V_3 < V_{SET3}$), then the MOS transistor M1 is turned on under the control of the driver 340, and the first output voltage $V_{OUT}$ is reduced. When the third monitoring voltage $V_3$ is not less than the third preset voltage $V_{SET3}$ ($V_3 \geqslant V_{SET3}$), all the terminals (e.g., the voltage detection terminal 311, the current detection terminal 312, then the adjusting terminal ADJF, the control terminal CMPO, the pulse width modulation terminal PWM, the overvoltage protection terminal OVP, the enable terminal ENA, and the load terminal LOAD) are turned off under the control of the driver 340, to prevent overloading the controller 220. The first preset voltage $V_{SET1}$ is less than the second preset voltage $V_{SET2}$, and the second preset voltage $V_{SET2}$ is less than the third preset voltage $V_{SET3}$. In an embodiment, the first preset voltage $V_{SET1}$ is 2.5V, the second preset voltage $V_{SET2}$ is 2.8V, and the third preset voltage $V_{SET3}$ is 3.5V.

Figure 4:
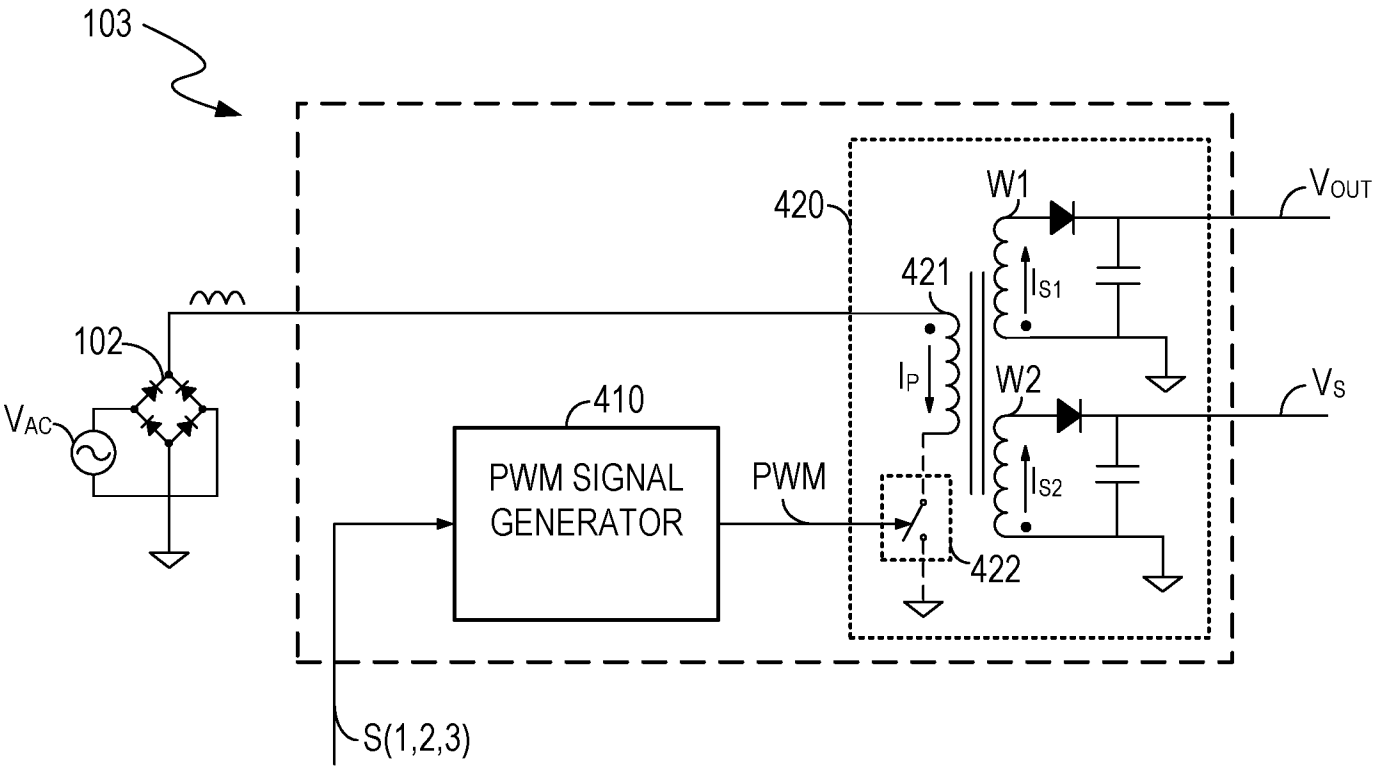
FIG. 4 shows a circuit diagram illustrating a power converter, in accordance with embodiments of the present invention.

FIG. 4 shows a circuit diagram illustrating the power converter 103, in accordance with embodiments of the present invention. The power converter 103 includes a pulse-width modulation (PWM) signal generator 410 and a switching-mode transformer circuit 420. The PWM signal generator 410 changes a duty cycle of a PWM signal according to the control signal S (which may be the first control signal S1, the second control signal S2, or the third control signal S3, similarly hereinafter in this paragraph), to control the transformer circuit 420 to adjust the first output voltage $V_{OUT}$ and the second output voltage $V_S$. In an embodiment, the PWM signal generator 410 reduces the duty cycle of the PWM signal according to the control signal S in a first state, to reduce the first output voltage $V_{OUT}$ and the second output voltage $V_S$. The PWM signal generator 410 increases the duty cycle of the PWM signal according to the control signal S in a second state, to increase the first output voltage $V_{OUT}$ and the second output voltage $V_S$.

The transformer circuit 420 includes a primary winding circuit 421, a secondary winding circuit W1, a secondary winding circuit W2, and a switch 422. A terminal of the primary winding circuit 421 is connected to the rectifier 102, and the other terminal is connected to the switch 422, to receive electric power from the power source $V_{AC}$ when the switch 422 is turned on. A terminal of the secondary winding circuit W1 is connected to the light source 104 to output the first output voltage $V_{OUT}$, and the other terminal is connected to a ground. A terminal of the secondary winding circuit W2 is connected to the voltage monitoring circuit 210 to output the second output voltage $V_S$, and the other terminal is connected to a ground.

In an embodiment, when the PWM signal is in a first state (e.g., a high level), the switch 422 is turned on, the primary winding circuit 421 receives electric power from the power source $V_{AC}$, the magnetic core of the transformer circuit 420 stores magnetic energy, and a primary current IP is generated at the primary winding circuit 421. When the PWM signal is in a second state (e.g., a low level), the switch 422 is turned off, and the primary winding circuit 421 does not receive electric power from the power source $V_{AC}$. Then, the magnetic core of the transformer circuit 420 releases magnetic energy to the secondary winding circuits W1, W2, so a secondary current $I_{S1}$ is generated at the secondary winding circuit W1 and a secondary current $I_{S2}$ is generated at the secondary winding circuit W2. The secondary current $I_{S1}$ flows into the light source 104 of FIG. 1 and FIG. 2, and the secondary current $I_{S2}$ flows into the voltage monitoring circuit 210. Therefore, the PWM signal controls the switch 422 to alternately enable and disable the power transfer from the power source $V_{AC}$ to the primary winding circuit 421. The first output voltage $V_{OUT}$ and the second output voltage $V_S$ can be increased or decreased by changing the duty cycle of a state (e.g., a high level) in the PWM signal. For example, if the duty cycle of the first state (e.g., a high level) is increased, both the first output voltage $V_{OUT}$ and the second output voltage $V_S$ are increased. In other embodiments, the transformer circuit 420 can include a center-tapped transformer topology, a flyback transformer topology, or a forward converter topology, or the like.

Figure 5:
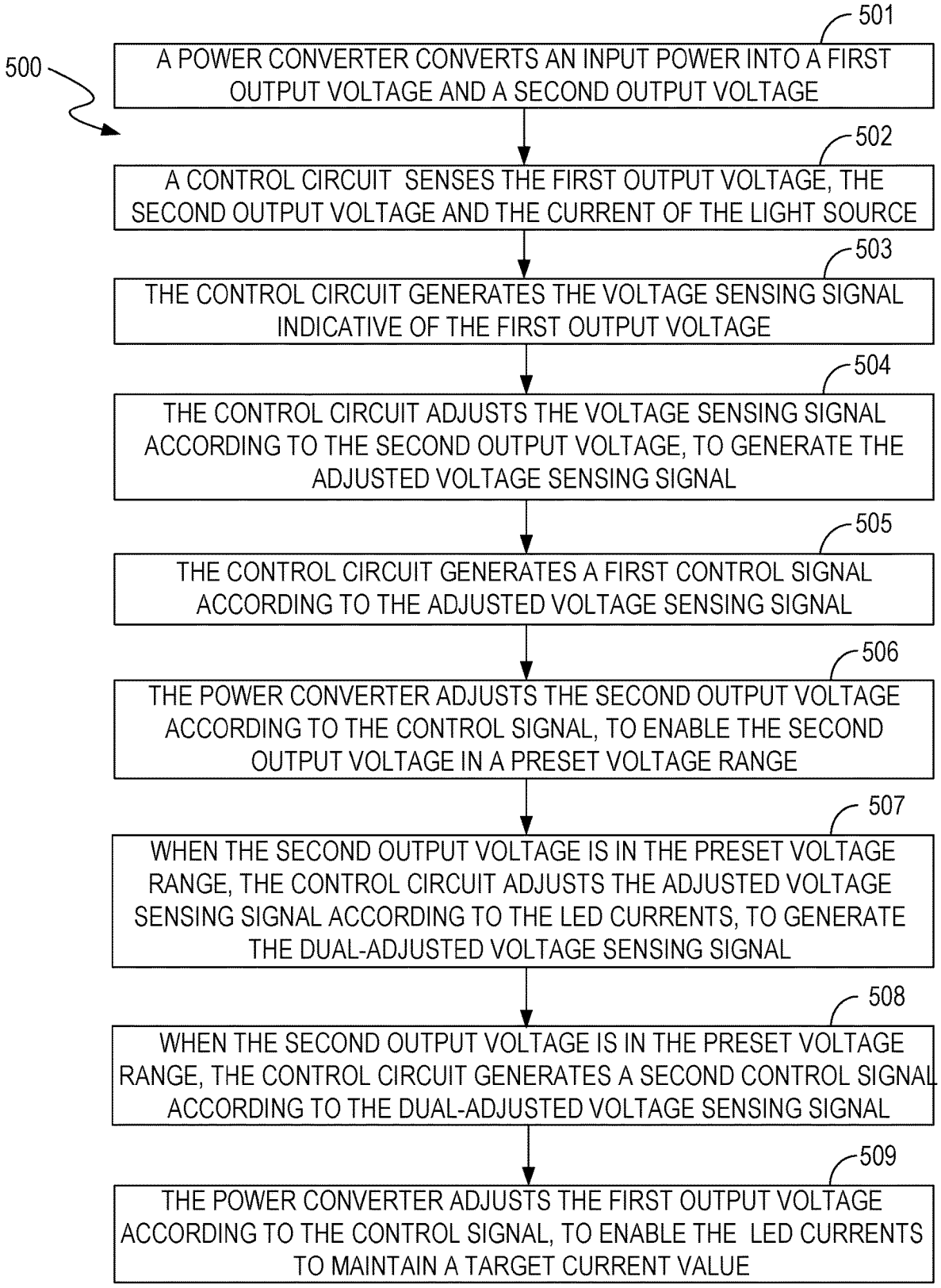
FIG. 5 shows a flowchart of a method for driving a light source, in accordance with embodiments of the present invention.

FIG. 5 shows a flowchart 500 of a method for driving a light source 104, in accordance with embodiments of the present invention. FIG. 5 is described in conjunction with FIG. 1 and FIG. 2.

In step 501, a power converter 103 converts an input power into a first output voltage $V_{OUT}$ and a second output voltage $V_S$. The first output voltage $V_{OUT}$ supplies electric power to the light source 104. The second output voltage $V_S$ supplies electric power to components in a system 100 except for the light source 104.

In step 502, a control circuit 105 senses the first output voltage $V_{OUT}$, the second output voltage $V_S$, and the current of the light source 104. Both the first output voltage $V_{OUT}$ and the second output voltage $V_S$ are sensed prior to the LED currents $I_1, I_2, \ldots, I_N$.

In step 503, the control circuit 105 generates the voltage sensing signal $V_{SEN}$ (the unadjusted voltage sensing signal $V_{SEN}$) indicative of the first output voltage $V_{OUT}$.

In step 504, the control circuit 105 adjusts the voltage sensing signal $V_{SEN}$ (the unadjusted voltage sensing signal $V_{SEN}$) according to the second output voltage $V_S$, to generate the adjusted voltage sensing signal $V_{SEN}$.

In step 505, the control circuit 105 generates a first control signal S1 according to the adjusted voltage sensing signal $V_{SEN}$.

In step 506, the power converter 103 adjusts the second output voltage $V_S$ according to the first control signal S1, to enable the second output voltage $V_S$ in a preset voltage range.

In step 507, when the second output voltage $V_S$ is in the preset voltage range, the control circuit 105 adjusts the adjusted voltage sensing signal $V_{SEN}$ according to the LED currents $I_1, I_2, \ldots, I_N$, to generate the twice-adjusted voltage sensing signal $V_{SEN}$.

In step 508, when the second output voltage $V_S$ is in the preset voltage range, the control circuit 105 generates a second control signal S2 according to the twice-adjusted voltage sensing signal $V_{SEN}$.

In step 509, the power converter 103 adjusts the first output voltage $V_{OUT}$ according to the second control signal S2, to enable the LED currents $I_1, I_2, \ldots, I_N$ to maintain a target current value.

Figure 6:
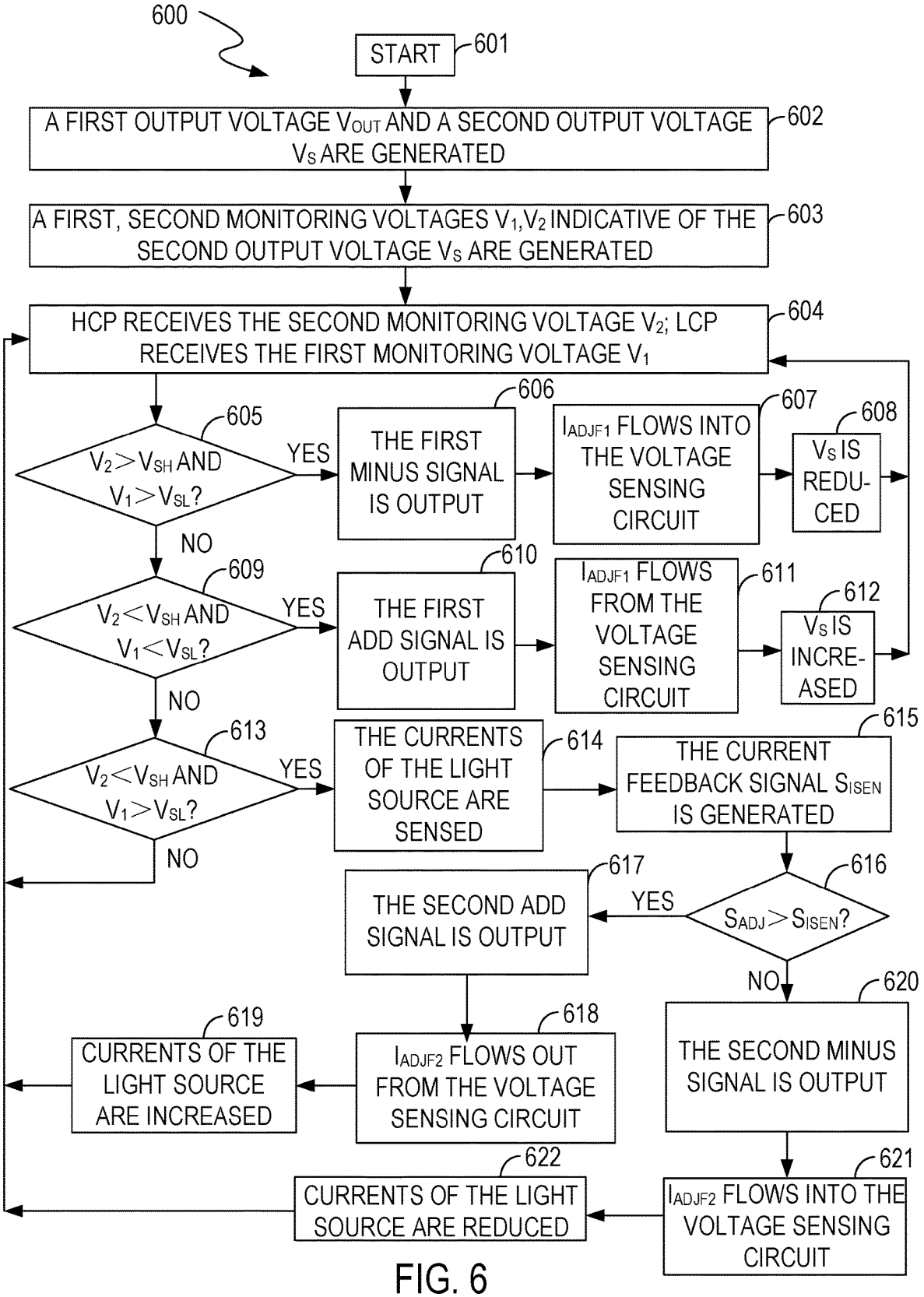
FIG. 6 shows a flowchart of a method for driving a light source, in accordance with embodiments of the present invention.

FIG. 6 shows a flowchart 600 of a method for driving a light source 104, in accordance with embodiments of the present invention. FIG. 6 is described in conjunction with FIG. 2 and FIG. 3.

In step 601, the system 200 for driving the light source 104 is powered on.

In step 602, the power converter 103 generates the first output voltage $V_{OUT}$ and the second output voltage $V_S$.

In step 603, the voltage monitoring circuit 210 generates the first monitoring voltage $V_1$ indicative of the second output voltage $V_S$, and also generates the second monitoring voltage $V_2$ indicative of the second output voltage $V_S$.

In step 604, the high clamp terminal HCP of the controller 220 receives the second monitoring voltage $V_2$, and the low clamp terminal LCP of the controller 220 receives the first monitoring voltage $V_1$.

In step 605, if the second monitoring voltage $V_2$ is greater than the high voltage threshold $V_{SH}$ and the first monitoring voltage $V_1$ is greater than the low voltage threshold $V_{SL}$ (that is, the comparator EA2 outputs a high level and the comparator EA1 outputs a low level), then step 605 is followed by step 606. Otherwise, step 605 is followed by step 609.

In step 606, the first logic circuit 313 does not output the first add signal and the second logic circuit 314 outputs the first minus signal.

In step 607, the conversion unit 315 generates the first adjusting current $I_{ADJF1}$ according to the first minus signal, to increase the voltage sensing signal $V_{SEN}$ (the unadjusted voltage sensing signal $V_{SEN}$) generated by the voltage sensing circuit 230. and the adjusted voltage sensing signal $V_{SEN}$ is generated after the voltage sensing signal $V_{SEN}$ (the unadjusted voltage sensing signal $V_{SEN}$) is increased. The first adjusting current $I_{ADJF1}$ flows from the conversion unit 315 to the voltage sensing circuit 230.

In step 608, under the conditions at this point of the flowchart 600, the adjusted voltage sensing signal $V_{SEN}$ is greater than the voltage reference signal $V_{REF}$, and so the first control current $I_{CMPO1}$ is reduced. The optical coupler 240 outputs the first control signal S1 in a first state after the first control current $I_{CMPO1}$ is reduced. The power converter 103 reduces the second output voltage $V_S$ according to the first control signal S1 in a first state, to enable the second output voltage $V_S$ in the preset voltage range. Then, step 608 is followed by step 604.

In step 609, if the second monitoring voltage $V_2$ is less than the high voltage threshold $V_{SH}$ and the first monitoring voltage $V_1$ is less than the low voltage threshold $V_{SL}$ (that is, the comparator EA2 outputs a low level and the comparator EA1 outputs a high level), then step 609 is followed by step 610. Otherwise, step 609 is followed by step 613.

In step 610, the first logic circuit 313 outputs the first add signal and the second logic circuit 314 does not output the first minus signal.

In step 611, the conversion unit 315 generates the first adjusting current $I_{ADJF1}$ according to the first add signal, to reduce the voltage sensing signal $V_{SEN}$ (the unadjusted voltage sensing signal $V_{SEN}$) generated by the voltage sensing circuit 230, and the adjusted voltage sensing signal $V_{SEN}$ is generated after the voltage sensing signal $V_{SEN}$ is reduced. The first adjusting current $I_{ADJF1}$ flows from the voltage sensing circuit 230 to the conversion unit 315.

In step 612, under the conditions at this point in the flowchart 600, the adjusted voltage sensing signal $V_{SEN}$ is less than the voltage reference signal $V_{REF}$, and so the first control current $I_{CMPO1}$ is increased. The optical coupler 240 outputs the first control signal S1 in a second state after the first control current $I_{CMPO1}$ is increased. The power converter 103 increases the second output voltage $V_S$ according to the first control signal S1 in a second state, to enable the second output voltage $V_S$ in the preset voltage range. Then, step 612 is followed by step 604.

In step 613, if the second monitoring voltage $V_2$ is less than the high voltage threshold $V_{SH}$ and the first monitoring voltage $V_1$ is greater than the low voltage threshold $V_{SL}$ (that is, the comparator EA2 outputs a low level and the comparator EA1 outputs a low level), then step 613 is followed by step 614. Otherwise, step 613 is followed by step 604.

In step 614, the current detection terminal ISEN1, ISEN2, ISENN senses the LED currents $I_1, I_2, \ldots, I_N$.

In step 615, the current sensing and balancing circuit 320 balances the LED currents $I_1, I_2, \ldots, I_N$ and generates the current feedback signal $S_{ISEN}$.

In step 616, if the current reference signal $S_{ADJ}$ is greater than the current feedback signal $S_{ISEN}$, then the comparator EA3 outputs a high level signal and the comparator EA4 outputs a low level signal, and step 616 is followed by step 617. Otherwise, the comparator EA3 outputs a low level signal and the comparator EA4 outputs a high level signal, and step 616 is followed by step 620.

In step 617, the first logic circuit 313 receives the high level signal and outputs the second add signal, and the second logic circuit 314 receives the low level signal and does not output the second minus signal.

In step 618, the conversion unit 315 generates the second adjusting current $I_{ADJF2}$ according to the second add signal, to reduce the adjusted voltage sensing signal $V_{SEN}$. The twice-adjusted voltage sensing signal $V_{SEN}$ is generated after the adjusted voltage sensing signal $V_{SEN}$ is reduced. The second adjusting current $I_{ADJF2}$ flows from the voltage sensing circuit 230 to the conversion unit 315.

In step 619, under the conditions at this point in the flowchart 600, the twice-adjusted voltage sensing signal $V_{SEN}$ is less than the voltage reference signal $V_{REF}$, and so the second control current $I_{CMPO2}$ is increased. The optical coupler 240 outputs the second control signal S2 in a second state after the second control current $I_{CMPO2}$ is increased. The power converter 103 increases the first output voltage $V_{OUT}$ according to the second control signal S2 in a second state, to enable the LED currents $I_1, I_2, \ldots, I_N$ to increase to the target current value. Then, step 619 is followed by step 604.

In step 620, the first logic circuit 313 receives the low level signal and does not output the second add signal, and the second logic circuit 314 receives the high level signal and outputs the second minus signal.

In step 621, the conversion unit 315 generates the second adjusting current $I_{ADJF2}$ according to the second minus signal, to increase the adjusted voltage sensing signal $V_{SEN}$. The twice-adjusted voltage sensing signal $V_{SEN}$ is generated after the adjusted voltage sensing signal $V_{SEN}$ is increased. The second adjusting current $I_{ADJF2}$ flows from the conversion unit 315 to the voltage sensing circuit 230.

In step 622, under the conditions at this point in the flowchart 600, the twice-adjusted voltage sensing signal $V_{SEN}$ is greater than the voltage reference signal $V_{REF}$, and so the second control current $I_{CMPO2}$ is reduced. The optical coupler 240 outputs the second control signal S2 in a first state after the second control current $I_{CMPO2}$ is reduced. The power converter 103 reduces the first output voltage $V_{OUT}$ according to the second control signal S2 in a first state, to enable the LED currents $I_1, I_2, \ldots, I_N$ to reduce to the target current value. Then, step 622 is followed by step 604.

As mentioned above, embodiments according to the present invention pertain to controllers, systems, and methods for driving a light source. The systems for driving the light source adjust the second output voltage $V_S$ according to the first output voltage $V_{OUT}$ and the second output voltage $V_S$, to enable the second output voltage $V_S$ in a preset voltage range. When the second output voltage $V_S$ is in the preset voltage range, the systems adjust the first output voltage $V_{OUT}$ according to the first output voltage $V_{OUT}$ and current of a light source, to enable the current of the light source to maintain the target current value. The systems enable the light source to work in the best possible state (e.g., the current of the light source is maintained at the target current value), to reduce power consumption. The systems are also compatible with a variety of displays, to simplify their design.

While the foregoing description and drawings represent embodiments of the present invention, it will be understood that various additions, modifications, and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A controller, operable for controlling a first output voltage that supplies electric power to a light source and also for controlling a second output voltage that supplies electric power to components except for said light source, wherein said first output voltage and said second output voltage are generated by a power converter, said controller comprising:

a voltage detection terminal, operable for sensing said second output voltage;

a current detection terminal coupled to said light source, operable for sensing a current of said light source, wherein said second output voltage is sensed prior to said current of said light source; and a voltage sensing terminal, coupled to said power converter through a voltage sensing circuit, operable for receiving a voltage sensing signal indicative of said first output voltage, wherein said voltage sensing signal is generated by said voltage sensing circuit; wherein said controller adjusts said voltage sensing signal based on said second output voltage, to generate an adjusted voltage sensing signal, and generates a first control current based on said adjusted voltage sensing signal, to enable said power converter to control said second output voltage in a preset voltage range based on said first control current;

wherein when said second output voltage is in said preset voltage range, said controller adjusts said adjusted voltage sensing signal based on a difference between said current of said light source and a target current value, to generate a twice-adjusted voltage sensing signal, and generates a second control current based on said twice-adjusted voltage sensing signal, to enable said power converter to control said current of said light source to maintain said target current value based on said second control current.

2. The controller of claim 1, further comprising:

an adjusting terminal, coupled to said voltage sensing circuit, operable for transferring a first adjusting current indicative of said second output voltage, to adjust said voltage sensing signal, thereby enabling said second output voltage in said preset voltage range; wherein said first adjusting current is generated by a comparison and feedback circuit of said controller;

wherein when said second output voltage is in said preset voltage range, then said adjusting terminal transfers a second adjusting current indicative of a difference between said current of said light source and said target current value, to adjust said adjusted voltage sensing signal, thereby enabling said current of said light source to maintain said target current value; and wherein said second adjusting current is generated by said comparison and feedback circuit.

3. The controller of claim 2, wherein said comparison and feedback circuit generates said second adjusting current to increase said adjusted voltage sensing signal if said current of said light source is greater than said target current value, and wherein said comparison and feedback circuit generates said second adjusting current to reduce said adjusted voltage sensing signal if said current of said light source is less than said target current value.

4. The controller of claim 2, wherein said voltage detection terminal comprises:

a low clamp terminal, coupled to a voltage monitoring circuit, operable for receiving a first monitoring voltage indicative of said second output voltage; and a high clamp terminal, coupled to said voltage monitoring circuit, operable for receiving a second monitoring voltage indicative of said second output voltage; wherein said first monitoring voltage and said second monitoring voltage are generated by said voltage monitoring circuit based on said second output voltage;

wherein said comparison and feedback circuit generates said first adjusting current based on a first comparison result and a second comparison result; wherein said first comparison result is generated based on said first monitoring voltage and a low voltage threshold, and wherein said second comparison result is generated based on said second monitoring voltage and a high voltage threshold.

5. The controller of claim 4, when said first comparison result is at a high level when said first monitoring voltage is less than said low voltage threshold, and said second comparison result is at a low level when said second monitoring voltage is not greater than said high voltage threshold, then said first adjusting current flows into said controller to reduce said voltage sensing signal.

6. The controller of claim 4, wherein when said first comparison result is at a low level when said first monitoring voltage is not less than said low voltage threshold, and said second comparison result is at a high level when said second monitoring voltage is greater than said high voltage threshold, then said first adjusting current flows from said controller to increase said voltage sensing signal.

7. The controller of claim 4, wherein when said first comparison result is at a low level when said first monitoring voltage is not less than said low voltage threshold, and said second comparison result is at a low level when said second monitoring voltage is not greater than said high voltage threshold, then said adjusting terminal transfers said second adjusting current to enable said current of said light source to maintain said target current value.

8. The controller of claim 4, wherein said comparison and feedback circuit comprises:

a first comparator, wherein a non-inverting input terminal of said first comparator is configured to receive said low voltage threshold, wherein an inverting input terminal of said first comparator is coupled to said low clamp terminal to receive said first monitoring voltage, wherein an output terminal of said first comparator outputs said first comparison result, and wherein said first comparison result is generated by said first comparator based on said first monitoring voltage and said low voltage threshold; and a second comparator, wherein a non-inverting input terminal of said second comparator is coupled to said high clamp terminal to receive said second monitoring voltage, wherein an inverting input terminal of said second comparator is configured to receive said high voltage threshold, wherein an output terminal of said second comparator outputs said second comparison result, and wherein said second comparison result is generated by said second comparator based on said second monitoring voltage and said high voltage threshold.

9. The controller of claim 8, wherein said comparison and feedback circuit further comprises:

a first logic circuit, coupled to said first comparator, operable for outputting a first add signal based on said first comparison result;

a second logic circuit, coupled to said second comparator, operable for outputting a first minus signal based on said second comparison result; and a conversion unit, coupled to said first logic circuit and said second logic circuit, operable for generating said first adjusting current based on said first add signal to reduce said voltage sensing signal, and also operable for generating said first adjusting current based on said first minus signal to increase said voltage sensing signal.

10. The controller of claim 9, wherein if said current of said light source is greater than said target current value, then said second logic circuit outputs a second minus signal and said conversion unit generates said second adjusting current based on said second minus signal to increase said adjusted voltage sensing signal; and wherein if said current of said light source is less than said target current value, then said first logic circuit outputs a second add signal and said conversion unit generates said second adjusting current based on said second add signal to reduce said adjusted voltage sensing signal.

11. The controller of claim 1, further comprising:

a driver, coupled to an enable terminal in said controller, operable for generating a driving signal based on a voltage signal; wherein said enable terminal generates said voltage signal when said light source is lit;

wherein a load unit coupled to said power converter is turned on for a preset time period based on said driving signal to reduce said first output voltage.

12. The controller of claim 1, further comprising:

a pulse width modulation terminal, operable for receiving a dimming signal indicative of preset brightness of said light source; and a current sensing and balancing circuit operable for controlling operating modes of a plurality of transistors and for balancing said current of said light source based on said dimming signal, wherein said current sensing and balancing circuit comprises said transistors coupled to said light source.

13. The controller of claim 12, wherein said operating modes comprise a linear mode and a switch mode; wherein when said preset brightness is in a first brightness range, then said current sensing and balancing circuit controls said transistors to operate in said linear mode; and wherein when said preset brightness is in a second brightness range, then said current sensing and balancing circuit controls said transistors to operate in said switch mode.

14. A system for driving a light source, said system comprising:

a power converter, operable for converting an input power to a first output voltage that supplies electric power to said light source, and also operable for converting said input power to a second output voltage that supplies electric power to components in said system except for said light source; and a control circuit, coupled to said power converter and said light source, operable for sensing said first output voltage, said second output voltage and a current of said light source; wherein both said first output voltage and said second output voltage are sensed prior to said current of said light source, wherein said control circuit generates a voltage sensing signal based on said first output voltage, adjusts said voltage sensing signal based on said second output voltage, to generate an adjusted voltage sensing signal, and generates a first control signal based on said adjusted voltage sensing signal, to enable said power converter to control said second output voltage in a preset voltage range based on said first control signal; wherein when said second output voltage is in said preset voltage range, said control circuit adjusts said adjusted voltage sensing signal based on said current of said light source, to generate a twice-adjusted voltage sensing signal, and generates a second control signal based on said twice-adjusted voltage sensing signal, to enable said power converter to control said current of said light source to maintain a target current value based on said second control signal.

15. The system of claim 14, wherein said control circuit comprises:

a voltage monitoring circuit, coupled to said power converter, operable for sensing said second output voltage, for generating a first monitoring voltage indicative of said second output voltage, and for generating a second monitoring voltage indicative of said second output voltage;

a controller, coupled to said light source and said voltage monitoring circuit, operable for generating a first adjusting current and a second adjusting current; wherein said first adjusting current is generated prior to said second adjusting current, wherein said first adjusting current is indicative of said first monitoring voltage and said second monitoring voltage, said second adjusting current is indicative of a difference between said current of said light source and said target current value; and a voltage sensing circuit, coupled to said power converter, operable for generating said voltage sensing signal indicative of said first output voltage, wherein said first adjusting current adjusts said voltage sensing signal, to generate said adjusted voltage sensing signal;

wherein said controller generates a first control current based on a comparison result of said adjusted voltage sensing signal and a voltage reference signal; wherein an optical coupler of said system generates said first control signal based on said first control current, to enable said power converter to control said second output voltage in said preset voltage range based on said first control signal; and wherein when said second output voltage is in said preset voltage range, said controller generates said second adjusting current to enable said current of said light current to maintain said target current value.

16. The system of claim 15, wherein when said first monitoring voltage is less than a low voltage threshold and said second monitoring voltage is not greater than a high voltage threshold, then said first adjusting current flows into said controller to reduce said voltage sensing signal.

17. The system of claim 15, wherein when said first monitoring voltage is not less than a low voltage threshold and said second monitoring voltage is greater than a high voltage threshold, then said first adjusting current flows from said controller to increase said voltage sensing signal.

18. The system of claim 15, wherein when said first monitoring voltage is not less than a low voltage threshold and said second monitoring voltage is not greater than a high voltage threshold, then said controller generates said second adjusting current to enable said current of said light source to maintain said target current value.

19. The system of claim 15, wherein said controller generates said second adjusting current to increase said adjusted voltage sensing signal if said current of said light source is greater than said target current value; and wherein said controller generates said second adjusting current to reduce said adjusted voltage sensing signal if said current of said light source is less than said target current value.

20. The system of claim 15, wherein said controller comprises:

a first comparator, wherein a non-inverting input terminal of said first comparator is configured to receive a low voltage threshold, an inverting input terminal of said first comparator is coupled to said voltage monitoring circuit to receive said first monitoring voltage, and an output terminal of said first comparator outputs a first comparison result; wherein said first comparison result is generated by said first comparator based on said first monitoring voltage and said low voltage threshold; and a second comparator, wherein a non-inverting input terminal of said second comparator is coupled to said voltage monitoring circuit to receive said second monitoring voltage, an inverting input terminal of said second comparator is configured to receive a high voltage threshold, and an output terminal of said second comparator outputs a second comparison result; wherein said second comparator result is generated by said second comparator based on said second monitoring voltage and said high voltage threshold.

21. The system of claim 20, wherein said controller further comprises:

a first logic circuit, coupled to said first comparator, operable for outputting a first add signal based on said first comparison result;

a second logic circuit, coupled to said second comparator, operable for outputting a first minus signal based on said second comparison result; and a conversion unit, coupled to said first logic circuit and said second logic circuit, operable for generating said first adjusting current based on said first add signal to reduce said voltage sensing signal, and also operable for generating said first adjusting current based on said first minus signal to increase said voltage sensing signal.

22. The system of claim 21, wherein if said current of said light source is greater than said target current value, then said second logic circuit outputs a second minus signal and said conversion unit generates said second adjusting current based on said second minus signal to increase said adjusted voltage sensing signal; and wherein if said current of said light source is less than said target current value, then said first logic circuit outputs a second add signal and said conversion unit generates said second adjusting current based on said second add signal to reduce said adjusted voltage sensing signal.

23. The system of claim 15, wherein said controller comprises:

a driver, coupled to a load unit of said system, operable for controlling said load unit to be turned on for a preset time period based on a voltage signal, to reduce said first output voltage; wherein said voltage signal is generated by said controller when said light source is lit.

24. The system of claim 15, wherein said controller comprises:

a current sensing and balancing circuit, operable for controlling operating modes of a plurality of transistors and for balancing said current of said light source based on a dimming signal indicative of preset brightness of said light source; wherein said current sensing and balancing circuit comprises said transistors coupled to said light source.

25. The system of claim 24, wherein said operating modes comprise a linear mode and a switch mode; wherein when said preset brightness is in a first brightness range, then said current sensing and balancing circuit controls said transistors to operate in said linear mode; and wherein when said preset brightness is in a second brightness range, then said current sensing and balancing circuit controls said transistors to operate in said switch mode.

26. A method for driving a light source, said method comprising:

converting, using a power converter, an input power to a first output voltage that supplies electric power to said light source and a second output voltage that supplies electric power to components except for said light source;

sensing, using a control circuit, said first output voltage, said second output voltage and a current of said light source; wherein both said first output voltage and said second output voltage are sensed prior to said current of said light source;

generating, using said control circuit, a voltage sensing signal indicative of said first output voltage;

adjusting, using said control circuit, said voltage sensing signal based on said second output voltage, to generate an adjusted voltage sensing signal;

generating, using said control circuit, a first control signal based on said adjusted voltage sensing signal;

adjusting, using said power converter, said second output voltage based on said first control signal, to enable said second output voltage in a preset voltage range;

adjusting, using said control circuit, said adjusted voltage sensing signal based on said current of said light source, to generate a twice-adjusted voltage sensing signal, when said second output voltage is in said preset voltage range;

generating, using said control circuit, a second control signal based on said twice-adjusted voltage sensing signal, when said second output voltage is in said preset voltage range; and adjusting, using said power converter, said first output voltage based on said second control signal, to enable said current of said light source to maintain a target current value.

27. The method of claim 26, wherein said adjusting said voltage sensing signal based on said second output voltage, to generate an adjusted voltage sensing signal and generating a first control signal based on said adjusted voltage sensing signal comprises:

sensing, using a voltage monitoring circuit of said control circuit, said second output voltage;

generating, using said voltage monitoring circuit, a first monitoring voltage indicative of said second output voltage and a second monitoring voltage indicative of said second output voltage;

generating, using a comparison and feedback circuit of a controller, a first comparison result based on said first monitoring voltage and a low voltage threshold;

generating, using said comparison and feedback circuit, a second comparison result based on said second monitoring voltage and a high voltage threshold;

generating, using said comparison and feedback circuit, a first adjusting current based on said first comparison result and said second comparison result;

adjusting, using said first adjusting current, said voltage sensing signal to generate said adjusted voltage sensing signal;

generating, using a shunt regulator of said controller, a first control current based on a comparison result of said adjusted voltage sensing signal and a voltage reference signal; and generating, using an optical coupler of said control circuit, said first control signal based on said first control current.

28. The method of claim 27, wherein when said first comparison result is at a high level when said first monitoring voltage is less than said low voltage threshold, and said second comparison result is at a low level when said second monitoring voltage is not greater than said high voltage threshold, then said first adjusting current flows into said controller to reduce said voltage sensing signal.

29. The method of claim 27, wherein when said first comparison result is at a low level when said first monitoring voltage is not less than said low voltage threshold, and said second comparison result is at a high level when said second monitoring voltage is greater than said high voltage threshold, then said first adjusting current flows from said controller to increase said voltage sensing signal.

30. The method of claim 27, wherein when said first comparison result is at a low level when said first monitoring voltage is not less than said low voltage threshold, and said second comparison result is at a low level when said second monitoring voltage is not greater than said high voltage threshold, then said comparison and feedback circuit generates a second adjusting current based on a difference between said current of said light source and said target current value, to enable said current of said light source to maintain said target current value.

31. The method of claim 27, further comprising:

generating, using a comparator of said controller, said second comparison result based on said second monitoring voltage and said high voltage threshold;

outputting, using a second logic circuit of said controller, a first minus signal based on said second comparison result; and generating, using a conversion unit of said controller, said first adjusting current to increase said voltage sensing signal based on said first minus signal.

32. The method of claim 27, said method comprising:

generating, using a comparator of said controller, said first comparison result based on said first monitoring voltage and said low voltage threshold;

outputting, using a first logic circuit of said controller, a first add signal based on said first comparison result; and generating, using a conversion unit of said controller, said first adjusting current based on said first add signal, to reduce said voltage sensing signal.

33. The method of claim 27, further comprising:

generating, using a comparator of said controller, a third comparison result based on a current feedback signal indicative of said current of said light source and a current reference signal indicative of said target current value;

outputting, using a first logic circuit of said controller, a second add signal based on said third comparison result; and generating, using said conversion unit, a second adjusting current based on said second add signal, to reduce said adjusted voltage sensing signal.

34. The method of claim 27, further comprising:

generating, using a comparator of said controller, a third comparison result based on a current feedback signal indicative of said current of said light source and a current reference signal indicative of said target current value;

outputting, using a second logic circuit of said controller, a second minus signal based on said third comparison result; and generating, using said conversion unit, a second adjusting current based on said second minus signal, to increase said adjusted voltage sensing signal.

35. The method of claim 26, further comprising:

generating, using said controller, a voltage signal when said light source is lit; and turning on, using a driver of said controller, a load unit for a preset time period based on said voltage signal, to reduce said first output voltage.

36. The method of claim 26, further comprising:

controlling, using said controller, operating modes of a plurality of transistors of a current sensing and balancing circuit based on a dimming signal indicative of preset brightness of said light source; and balancing said current of said light source based on said dimming signal indicative of preset brightness of said light source.

37. The method of claim 36, wherein said operating modes comprise a linear mode and a switch mode; wherein when said preset brightness is in a first brightness range, then said current sensing and balancing circuit controls said transistors to operate in said linear mode; and wherein when said preset brightness is in a second brightness range, said current sensing and balancing circuit controls said transistors to operate in said switch mode.

* * * * *